US009593881B2

(12) United States Patent
Nelson et al.

(10) Patent No.: US 9,593,881 B2
(45) Date of Patent: Mar. 14, 2017

(54) SUPERCONDUCTING SYSTEM FOR ENHANCED NATURAL GAS PRODUCTION

(75) Inventors: Eric D Nelson, Houston, TX (US); Peter C Rasmussen, Pensacola, FL (US); John B Stone, Kingwood, TX (US); Stanley O Uptigrove, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 836 days.

(21) Appl. No.: 13/519,105

(22) PCT Filed: Jan. 6, 2011

(86) PCT No.: PCT/US2011/020382

§ 371 (c)(1),
(2), (4) Date: Jun. 25, 2012

(87) PCT Pub. No.: WO2011/094043

PCT Pub. Date: Aug. 4, 2011

(65) Prior Publication Data

US 2012/0289407 A1 Nov. 15, 2012

Related U.S. Application Data

(60) Provisional application No. 61/298,799, filed on Jan. 27, 2010, provisional application No. 61/423,396, filed on Dec. 15, 2010.

(51) Int. Cl.

| | |
|---|---|
| ***F25D 31/00*** | (2006.01) |
| ***F25J 1/00*** | (2006.01) |
| ***F25J 1/02*** | (2006.01) |

(52) U.S. Cl.

CPC ..... *F25J 1/0022* (2013.01); *F25J 1/004* (2013.01); *F25J 1/005* (2013.01); *F25J 1/0042* (2013.01);

(Continued)

(58) Field of Classification Search

CPC ..... F25J 1/0287; F25J 1/0065; F25J 1/0208; F25J 1/0042; F25J 1/0052; F25J 1/0072; F25J 1/0235; F25J 1/0236

(Continued)

(56) References Cited

U.S. PATENT DOCUMENTS

| | | | | |
|---|---|---|---|---|
| 4,908,347 A * | 3/1990 | Denk | ..... | 505/166 |
| 5,091,361 A | 2/1992 | Hed | ..... | 505/1 |

(Continued)

FOREIGN PATENT DOCUMENTS

| | | |
|---|---|---|
| CN | 201280912 | 7/2009 |
| JP | 2002-130851 | 9/2002 |

(Continued)

OTHER PUBLICATIONS

PCT International Search and Written Opinion dated Mar. 1, 2011, 11 pages.

*Primary Examiner* — Frantz Jules
*Assistant Examiner* — Brian King
(74) *Attorney, Agent, or Firm* — ExxonMobil Upstream Research Company Law Department

(57) ABSTRACT

Provided is a natural gas processing facility for the liquefaction or regasification of natural gas. The facility includes a primary processing unit, e.g., refrigeration unit, for warming natural gas or chilling natural gas to at least a temperature of liquefaction. The facility also has superconducting electrical components integrated into the facility. The superconducting electrical components incorporate superconducting material so as to improve electrical efficiency of the facility by at least one percent over what would be experienced through the use of conventional electrical components. The superconducting electrical components may be one or more motors, one or more generators, one or more transformers, switch gears, one or more electrical transmis- (Continued)

sion conductors, variable speed drives, or combinations thereof.

36 Claims, 6 Drawing Sheets

(52) U.S. Cl.
CPC ..... *F25J 1/0045* (2013.01); *F25J 1/0052* (2013.01); *F25J 1/0057* (2013.01); *F25J 1/0065* (2013.01); *F25J 1/0072* (2013.01); *F25J 1/023* (2013.01); *F25J 1/025* (2013.01); *F25J 1/0208* (2013.01); *F25J 1/0219* (2013.01); *F25J 1/0236* (2013.01); *F25J 1/0247* (2013.01); *F25J 1/0249* (2013.01); *F25J 1/0265* (2013.01); *F25J 1/0278* (2013.01); *F25J 1/0279* (2013.01); *F25J 1/0284* (2013.01); *F25J 1/0292* (2013.01); *F25J 2210/06* (2013.01); *F25J 2220/62* (2013.01); *F25J 2230/22* (2013.01); *F25J 2230/60* (2013.01); *F25J 2245/90* (2013.01)

(58) Field of Classification Search
USPC ..... 62/617
See application file for complete search history.

(56) References Cited

U.S. PATENT DOCUMENTS

| | | | | |
|---|---|---|---|---|
| 6,293,106 | B1 * | 9/2001 | Acharya et al. | 62/3.1 |
| 6,640,586 | B1 * | 11/2003 | Baudat | F25J 1/0282 62/611 |
| 6,668,562 | B1 * | 12/2003 | Shatten | B02C 19/186 62/50.2 |
| 7,406,829 | B2 | 8/2008 | Coffinberry | 60/801 |
| 2003/0190506 | A1 * | 10/2003 | Mueller | 429/20 |
| 2003/0226373 | A1 | 12/2003 | Prible et al. | 62/612 |
| 2007/0240451 | A1 | 10/2007 | Fogarty et al. | 62/643 |
| 2009/0170706 | A1 | 7/2009 | Hirose et al. | 505/163 |
| 2009/0199576 | A1 | 8/2009 | Ciccarelli | 62/503.3 |
| 2009/0249828 | A1 | 10/2009 | Ransbarger | 62/611 |

FOREIGN PATENT DOCUMENTS

| | | | |
|---|---|---|---|
| JP | 2007-083851 | 9/2005 | |
| JP | 2008-124175 | 11/2006 | |
| JP | 2007-083851 | 4/2007 | B63J 2/12 |
| WO | WO99-42706 | 8/1999 | F01K 3/20 |
| WO | WO2009-070379 | 6/2009 | F17C 9/02 |

* cited by examiner

SUPERCONDUCTING SYSTEM FOR ENHANCED NATURAL GAS PRODUCTION

CROSS-REFERENCE TO RELATED APPLICATIONS

The present application is the National Stage of International Application No. PCT/US2011/020382, filed Jan. 6, 2011, which claims priority to and the benefit of U.S. Provisional Application No. 61/298,799, which was filed on 27 Jan. 2010, entitled "Superconducting System for Enhanced Liquefied Natural Gas Production," and U.S. Provisional Patent Application No. 61/423,396, which was filed on 15 Dec. 2010, entitled "Superconducting System For Enhanced Natural Gas Production," which are incorporated by reference herein.

FIELD OF THE INVENTION

The present invention relates to the field of gas processing and the cooling or warming of natural gas. More specifically, the present invention relates to the use of superconducting components in a liquefied natural gas facility.

BACKGROUND

As the world's demand for fossil fuels increases, energy companies find themselves pursuing hydrocarbon resources located in more remote areas of the world. Such pursuits take place both onshore and offshore. One type of fossil fuel is natural gas. The phrase "natural gas" usually refers to methane. Natural gas may also include ethane, propane, and trace elements of helium, nitrogen, $CO_2$, and $H_2S$.

Natural gas in commercially available quantities is often found in locations remote from existing natural gas markets. Thus, it is necessary to transport the natural gas great distances. This is oftentimes done by means of tankers that cross large ocean bodies.

To increase the volumetric capacity of a tanker with respect to the gaseous commodity being transported, it is known to liquefy the natural gas. Liquefaction is done by cooling the gas-phase product to condense it into a liquid phase. This, in turn, reduces its volume for economic transportation to a distant market.

A condensed natural gas product is typically referred to as liquefied natural gas, or "LNG." LNG takes up about 1/600th the volume of natural gas in the gaseous state. LNG is generally odorless, colorless, non-toxic and non-corrosive. Specialized LNG vessels have been designed to transport LNG. In addition, LNG terminals have been erected that receive the offloaded LNG and vaporize it back to its natural gas state. In some instances, the offloaded LNG is stored in tanks on or near shore or in underground reservoirs. In other instances, the offloaded LNG is released into a natural gas transmission grid for the existing natural gas market.

In the area of original production, the liquefaction process is carried out in a LNG plant, which may be very capital-intensive. Large refrigeration units are required to bring natural gas down to a temperature needed for phase change into a liquid state. In the case of methane, the condensation point is approximately −162° C. (−260° F.).

In an LNG plant, one or more refrigerant streams are placed in heat exchange with the natural gas in production. The refrigerants typically are pure component hydrocarbons such as methane, ethane, ethylene, propane, a butane, a pentane, or a mixture of these components. Nitrogen may also be used in a blend. The very large sizes of LNG liquefaction plants make for some of the lowest unit-cost cryogenic refrigeration systems in the world.

LNG plants rely on large compressors. In most LNG plants, the refrigeration compressors are directly driven by large gas turbine engines. The plants may employ generators to provide electrical power for electric motors driving smaller loads. The compressors and the generators require significant power generation and a considerable distribution system.

It is also noted that many of the reservoirs currently in production and available for the processing of liquefied natural gas are in relatively deep waters. Such waters tend to be remote from land. To reduce the infrastructure and costs of transporting produced gas to shore, the LNG industry has considered the development of floating, LNG processing plants. In this instance, the natural gas would be chilled on location, and then offloaded directly onto an LNG tanker for immediate transport.

One of the challenges associated with such an offshore project relates to the space and weight requirements of the very large LNG production facilities. Placing such large facilities onto the deck and into the hull of a ship may not be commercially feasible. The alternative is to erect a platform using, for example, structural steel. This too requires significant infrastructure costs.

LNG receiving terminals and regasification facilities can also be either off shore or on shore and require pumps and other rotating equipment. These facilities often have stand alone power generation equipment or are built next to a power generation facility that utilizes the natural gas as a fuel source for producing electric power through a gas turbine and generator possibly including combined cycle power generation.

A need therefore exists for a gas processing plant, power plant, LNG receiving and regasification facility that utilizes equipment having a smaller footprint than currently-utilized gas processing components. A need further exists for a gas processing plant, power plant, LNG receiving and regasification facility that utilizes components having a higher efficiency in the utilization of electrical power, resulting in reduced fuel demand and lower greenhouse gas emissions.

SUMMARY OF THE INVENTION

The facilities and methods described herein have various benefits in the processing of natural gas. In various embodiments, such benefits may include the use of electrical components having a smaller footprint and/or smaller weight than known power-generating equipment used for an LNG plant. Such benefits may also include the incorporation of superconducting electrical components such as motors, generators, transformers, switch gears, transmission conductors, variable speed drives or other equipment for power generation, transmission, distribution and utilization to provide improved efficiency of the electrical service. The provided facilities reduce the energy required to drive the turbines and shafts associated with an LNG plant.

The provided facilities improve the efficiency of the generation, distribution, and utilization of mechanical or electrical power and thereby benefit the LNG liquefaction process. The enhanced efficiency reduces capital costs and fuel requirements. Such may also reduce air emissions associated with combustible fuel-driven power generation. Moreover, the use of smaller processing components provides a cost savings by avoiding the infrastructure associated with supporting the larger gas-driven equipment and traditional electrical generators on a ship or offshore platform.

The provided natural gas processing facility includes an electrical power source for providing power to the facility, a primary processing unit, e.g., refrigeration unit, for chilling or warming natural gas, at least one superconducting electrical component, an incoming refrigerant line, and an outgoing refrigerant line. The facility operates to warm/regasify natural gas or cool natural gas to a state of liquefaction.

BRIEF DESCRIPTION OF THE DRAWINGS

So that the present inventions can be better understood, certain drawings, charts, graphs and flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
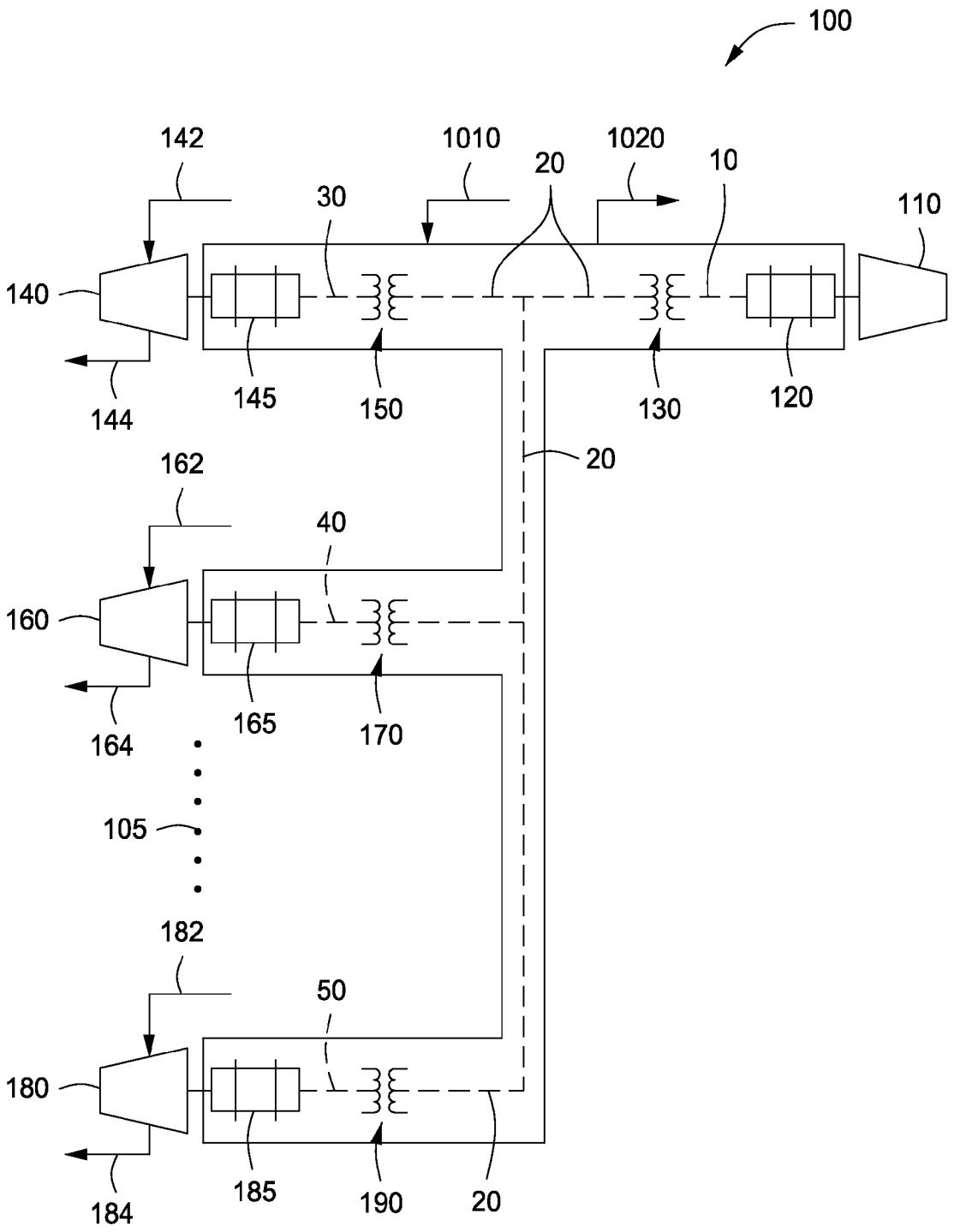
FIG. 1 is a schematic view of a superconducting electrical system as may be used in support of a liquefied natural gas liquefaction process, in one embodiment.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "gas" refers to a fluid that is in its vapor phase at 1 atm and 15° C.

As used herein, the term "condensable hydrocarbons" means those hydrocarbons that condense to a liquid at about 15° C. and one atmosphere absolute pressure. Condensable hydrocarbons may include a mixture of hydrocarbons having carbon numbers greater than 4.

As used herein, the term "non-condensable" means those chemical species that do not condense to a liquid at about 15° C. and one atmosphere absolute pressure. Non-condensable species may include non-condensable hydrocarbons and non-condensable non-hydrocarbon species such as, for example, carbon dioxide, hydrogen, carbon monoxide, hydrogen sulfide, and nitrogen. Non-condensable hydrocarbons may include hydrocarbons having carbon numbers less than 5.

The term "liquefied natural gas" or "LNG," is natural gas generally known to include a high percentage of methane, but optionally other elements and/or compounds including, but not limited to, ethane, propane, butane, carbon dioxide, nitrogen, helium, hydrogen sulfide, or combinations thereof) that has been processed to remove one or more components (for instance, helium) or impurities (for instance, water and/or heavy hydrocarbons) and then condensed into a liquid at almost atmospheric pressure by cooling.

As used herein, the term "oil" refers to a hydrocarbon fluid containing primarily a mixture of condensable hydrocarbons.

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

As discussed above, it is desirable to replace the large, combustible-fuel-powered turbines or conventional electrical drivers/generators with smaller, electrical power-generating equipment. Recently, technology has been developed that allows motors and generators to convert between electrical power and mechanical power at very high efficiencies, but with smaller footprints. Such technology takes advantage of a phenomenon known as superconductivity.

First, a facility for the regasification or liquefaction of natural gas is provided. In one aspect, the facility includes an electrical power source for providing power to the facility.

The electrical power source will typically comprise a power grid, at least one gas turbine generator, or combinations thereof.

The facility also includes a primary processing unit, e.g., refrigeration unit, which is understood in some embodiments to be the only processing unit, i.e., the processing unit, in the facility. The primary refrigeration unit chills natural gas at least to a temperature of liquefaction. The primary refrigeration unit has a first refrigerant circulated therethrough. The first refrigerant is preferably circulated through a refrigerant circulation line in the primary refrigeration unit.

The facility operates to regas natural gas or cool natural gas to a state of liquefaction. Therefore, the facility includes a natural gas inlet line and a natural gas outlet line. The natural gas inlet line delivers natural gas to the primary refrigeration unit, and the natural gas outlet line releases liquefied natural gas from the primary refrigeration unit. In some cases, the natural gas in the natural gas inlet line may be pre-cooled through a previous refrigeration unit.

In order to chill the natural gas for liquefaction, the facility includes a first refrigerant inlet line. The first refrigerant inlet line delivers the first refrigerant to the primary refrigeration unit. The first refrigerant is then delivered to the refrigerant circulation line.

In order to facilitate the liquefaction process, the facility employs various electrical components. In the present inventions, at least some of those components are superconducting electrical components. The superconducting electrical components incorporate superconducting material so as to improve electrical efficiency of the service provided by the components by at least one percent over what would otherwise be experienced through the use of conventional electrical components. The superconducting electrical components may represent one or more motors, one or more generators, one or more transformers, one or more electrical transmission conductors, one or more switch gears, one or more variable speed drives or combinations thereof.

Preferably, the superconducting electrical components weigh at least about one-third less than the weight of equivalent non-superconducting components. In addition, the superconducting electrical components preferably have a footprint that is at least about one-third smaller than the footprint of equivalent non-superconducting components.

The superconducting electrical components require cooling through the circulation of the LNG or second refrigerant. More specifically, the superconducting electrical components need to remain below a critical temperature for continued superconductivity. To implement this, the facility includes an incoming refrigerant line and an outgoing refrigerant line. The incoming refrigerant line delivers the LNG or second refrigerant to the superconducting electrical components. This maintains the superconducting electrical components below a critical temperature. The outgoing refrigerant line releases the refrigerant from the superconducting electrical components.

In one arrangement, at least one of the superconducting electrical components is a motor for turning a shaft. The shaft turns a mechanical component of a compressor or pump for compressing or pumping the LNG or refrigerant stream. In a more preferred instance, the facility comprises a plurality of compressors and/or pumps for compressing or pumping gas or liquid streams and the superconducting electrical components include a plurality of motors for turning respective shafts. The respective shafts turn corresponding mechanical components of compressors or pumps for compressing or pumping gas and liquid streams in the facility.

In one aspect, the facility is placed offshore. In this instance, the facility further includes an offshore unit for supporting the facility for the liquefaction or gasification of natural gas. The offshore unit may be, for example, a floating vessel, a ship-shaped vessel, or a mechanical structure founded on the sea floor.

In one embodiment, the first refrigerant and the second refrigerant are the same refrigerant. In one implementation of this embodiment, the second refrigerant is cooled at least partially by the primary refrigeration unit. For this implementation, the facility may further comprise a refrigerant slip line. The refrigerant slip line delivers a portion of the first refrigerant to the incoming refrigerant line used for delivering the second refrigerant to the at least one superconducting electrical component.

In another implementation of this embodiment, the second refrigerant is cooled at least partially by a separate refrigeration unit. For this implementation, the facility further comprises an ancillary refrigeration unit, along with an incoming refrigerant slip line and an outgoing refrigerant slip line for the ancillary refrigeration unit. The incoming refrigerant slip line takes a portion of the first refrigerant from the first refrigerant inlet line, and delivers the portion of the first refrigerant to the ancillary refrigeration unit as a third refrigerant. The outgoing refrigerant slip line delivers a portion of the third refrigerant to the incoming refrigerant line used for delivering the second refrigerant to the at least one superconducting electrical component. In one aspect, the duty of the ancillary refrigeration unit is controlled independently from the main refrigeration unit.

In another embodiment, the second refrigerant for maintaining the at least one superconducting electrical component below a critical temperature comprises an independent refrigerant having a composition that differs from the first refrigerant, and not in fluid communication with the first refrigerant. In one implementation of the embodiment, the second and independent refrigerant is cooled in the primary refrigeration unit and is in fluid communication with the incoming refrigerant line for delivering the second refrigerant to the at least one superconducting electrical component. The warmed independent refrigerant is then compressed in a compression system independent from a primary refrigeration compressor.

In another implementation of the embodiment, the second refrigerant for maintaining the at least one superconducting electrical component below a critical temperature comprises a portion of the liquefied natural gas from the natural gas outlet line. The portion of the liquefied natural gas is taken from the natural gas outlet line as a slip stream, and the slip stream is in fluid communication with the incoming refrigerant line for delivering the second refrigerant to the at least one superconducting electrical component. The second natural gas outlet line could, in one embodiment, take the portion of the liquefied natural gas at either an intermediate or a final stage of cooling. The intermediate or final stage of cooling could provide sub-cooling below the temperature normally required for LNG liquefaction but sufficient to cool the superconducting components below the critical temperature.

For a conductor in its "normal" state, an electrical current moves through the conductor in the form of a continuous or alternating "current" of electrons. The electrons move across a heavy ionic lattice within the conductor. As the electrons move through the lattice, they constantly collide with the ions in the lattice. During each collision, some of the energy carried by the current is absorbed by the lattice. As a result, energy carried by the electron current is dissipated. This condition is known as electrical resistance.

It is known that the electrical resistivity of a metallic conductor decreases gradually as the temperature is lowered. In commonly used conductors such as copper and silver, impurities and other defects impose a lower limit. Even near absolute zero, a typical sample of copper shows a positive resistance. However, some materials, known as superconductors, reach a resistance approaching zero despite the imperfections.

Superconductivity is a reference to materials that have virtually no electrical resistance to current at very low temperatures. This occurs in the absence of an interior magnetic field. A material that achieves superconductivity is known as a superconductor.

Each superconductor has its own point at which resistance drops close to zero. This temperature is known as the "critical temperature," or $T_c$.

Superconductivity was discovered in 1911 by Heike Kamerlingh Onnes of The Netherlands. At that time, Onnes was studying the electrical resistance of solid mercury at cryogenic temperatures. Onnes used liquid helium as a refrigerant. Onnes observed that at a temperature of 4.2 K, the resistance of solid mercury abruptly disappeared.

In subsequent decades, superconductivity was found in several other materials. For example, in 1913, lead was found to "superconduct" at 7 K. Superconductivity is now known to occur in a variety of materials. These include simple elements like tin and aluminum as well as certain metallic alloys. Superconductivity generally does not occur in noble metals like gold and silver, nor does it occur in pure samples of ferromagnetic metals.

It is desirable that materials be identified that have superconductive qualities at higher temperatures. Specifically, it is desirable that such materials be identified where the superconductivity is at a temperature higher than the boiling point of nitrogen. At atmospheric pressure, the boiling point of nitrogen is 77 K. The use of nitrogen as a refrigerant is commercially important because liquid nitrogen can be readily produced on-site from air.

In 1986, Georg Bednorz and Karl Müller, while working at an IBM laboratory in Zurich, discovered that certain semiconducting oxides become superconducting at a temperature of 35 K. The material was lanthanum barium copper oxide, which is an oxygen-deficient perovskite-related material. However, the critical temperature was well below the boiling point of nitrogen.

It was soon thereafter discovered by M. K. Wu, et al. that the lanthanum component could be replaced with yttrium, making yttrium barium copper oxide, or "YBCO." YBCO is a crystalline chemical compound with the formula $YBa_2Cu_3O_7$. YBCO was found to achieve superconductivity above the boiling point of nitrogen. Specifically, YBCO raised the critical temperature of superconductivity to about 92 K.

Other cuprate superconductors have since been discovered. Of significance, bismuth strontium calcium copper oxide, or BSCCO has been developed. BSCCO is a family of high-temperature superconductors having the generalized chemical formula $Bi_2Sr_2Ca_nCu_{n+1}O_{2n+6-d}$. BSCCO was discovered in 1988, and represented the first high-temperature superconductor which did not contain a rare earth element.

Specific types of BSCCO are usually referred to by using the sequence of the numbers of the metallic ions. For example, BSCCO-2212 is denoted as $Bi_2Sr_2Ca_1Cu_2O_8$. BSCCO-2223 is denoted as ($Bi_2Sr_2Ca_2Cu_3O_{10}$). Each of these BSCCO materials has a critical temperature in excess of 90 K, which is well above the boiling point of liquid nitrogen. The significance of the discovery of YBCO is the much lower cost of the refrigerant needed to cool the material to below the critical temperature.

Superconductive materials have been used in the construction of components for electrical generation. These materials provide a reduced resistance to the flow of electricity. Superconductive materials may be beneficially employed in power cables, in magnets for rotors and stators, and so forth. It is believed that by substituting superconducting electrical components for standard electrical components, the efficiency of power distribution from electrical power generation to the end-application is increased by about 1 to 3 percent for comparably-sized equipment. Because of the higher current density of superconducting components, the size and weight of the motors and generators can be reduced by one-third compared to their conventional counterparts.

It is proposed herein to use superconducting electrical components. Such electrical components include superconducting motors, generators, transformers, and transmission lines. Superconducting materials can reduce the resistance of a such components, allowing for a reduction in the weight and volume of material needed to transmit electricity in an LNG production facility and increase the efficiency of electrical power utilization, generation, and consumption in that facility. Methods for cooling the superconducting electrical components are also offered herein.

The superconducting components may be applied to any of the large electrical loads needed in an LNG facility. Such loads are most often associated with shafts that drive compressors for handling the inlet gas, for recovering LNG boil-off gas from the tanks and loading system, and for generating the power required to generally operate the plant. The use of superconducting electrical components is particularly advantageous in providing an all-electric LNG system such that the large refrigeration compressors may be driven with electric motors rather than the traditional gas-turbine driven refrigeration compressors.

Electric motors provide improved reliability over gas-turbine driven compressors. Electric motors can also reduce fuel consumption and emissions by allowing the use of a higher efficiency combined cycle power plant. Finally, the consolidation of the power generation into electrical form may allow cost reductions to be obtained through selection of larger gas turbine drivers which typically have a smaller unit cost. Thus, instead of having gas turbines at every refrigerant compressor, for example, a smaller number of larger gas turbines that power the electrical system can be employed.

The drawback of superconducting components is that they operate at cryogenic temperatures. As noted, the temperature at which a material transitions between regular conducting and superconducting is called the critical temperature. So-called high temperature superconducting (HTS) materials are those that have a critical temperature warmer than the atmospheric boiling point of liquid nitrogen (77 K). The highest known critical temperature to date is 138 K. Bismuth strontium calcium copper oxide (BSCCO) has critical temperatures of about 95 K to 107 K. Beneficially, BSCCO materials have the ability to be formed into superconducting wires. It is worth noting that the atmospheric boiling point of LNG is approximately 105 K.

To keep superconducting materials cool, a coolant or "refrigerant" must be provided. Typically, for HTS materials liquid nitrogen is used due to its ready availability. The liquid nitrogen is obtained from an external supply or it is generated from the atmosphere using a "cryo-cooler". Nitrogen typically is not used alone for cooling a natural gas product for liquefaction; rather, a hydrocarbon gas such as methane, ethane, ethylene, propane, a butane, a pentane, or a mixture of these components is used. Nitrogen is preferably used in a blend with one or more hydrocarbon gases or, in some cases, in pure form but in conjunction with previous hydrocarbon refrigeration services. Because natural gas liquefaction is done at such a large scale commercially, it is the source of very low unit-cost, low temperature refrigeration that can be advantageously used to source low-cost cooling for superconducting components.

FIG. 1 is a schematic view of a superconducting electrical system 100 as may be used in support of a liquefied natural gas liquefaction process, in one embodiment. In the system 100, all electrical components are superconducting for maximum efficiency and weight savings. However, it is understood that the system 100 may be modified so that only a subset of components or even only one or two selected individual components are superconducting. As used herein, all non-superconducting electrical components may be referred to as conventional components.

In the system 100, a source of mechanical energy 110 is first provided. The source of mechanical energy 110 may be a gas turbine. Alternatively, the source of mechanical energy 110 may be a diesel engine, a steam turbine, or a process gas or liquid expansion turbine. The source of mechanical energy 110 drives a superconducting generator 120. The superconducting generator 120, in turn, produces electrical power.

Preferably, the electrical power is transmitted over a superconducting transmission line 10. The electrical power may then be converted, or stepped up or down, to a more appropriate distribution voltage by a superconducting transformer 130.

The source of mechanical energy 110, the generator 120, the transmission line 10, and the transformer 130 operate together as a power generation unit to provide energy to any of a number of electrical loads in an LNG production facility. Larger LNG facilities may employ a number of power generation units together. In the arrangement of FIG. 1, electrical energy, or power, is supplied to the electrical loads through a superconducting transmission line 20. However, it is understood that the source of mechanical energy 110, the generator 120, the transmission line 10, and the transformer 130, may be replaced or supplemented with a tie-in to an existing commercial electrical grid. The electrical grid will then deliver power through the superconducting transmission line 20 as a "last mile" tie-in.

The electrical loads in the LNG production facility represent various electrical components. One such load is a compressor 140. The compressor 140 compresses a gas stream. A stream input line is seen at 142. The compressor 140 then discharges the gas stream at a higher pressure. A high pressure stream is shown at 144. The compressor 140 may be any of a variety of compressors. For example, compressor 140 may be a compressor for pressurizing gas released from liquefied natural gas, referred to as "boil-off gas." Those of ordinary skill in the art will understand that the liquefaction process for natural gas incidentally causes a vaporization of cold methane or other refrigerant at various stages. The compressor may also be used to repressurize a warmed refrigerant.

The compressor 140 is driven by a superconducting motor 145. The motor 145 may be supplied at the required voltage by the combination of a superconducting transmission line 30 and a superconducting transformer 150.

Other significant electrical loads may exist in a natural gas liquefaction plant. These may represent additional compressors. FIG. 1 presents two additional compressors 160 and 180. Compressor 160 may be, for example, a first refrigerant compressor, while compressor 180 may be, for example, a cooling water pump, a second refrigerant compressor, or other mechanical load.

Each of the compressors 160, 180 compresses a gas stream or pumps a liquid stream. Respective stream input lines are seen at 162 and 182. The compressors 160, 180 then discharge the gas stream at a higher pressure. High pressure streams are shown at 164 and 184.

The compressors 160, 180 are driven by respective superconducting motors 165, 185. The motors 165, 185 are supplied at the required voltage by the combination of superconducting transmission lines 40, 50 and may require corresponding superconducting transformers 170, 180. Thus, the components associated with the additional compressors 160, 180 may also be serviced with superconductors.

The superconducting electrical system 100 may have additional compressors and pumps and associated transformers, motors and gas or liquid streams. This is indicated schematically by dashed line 105. In addition, and as noted above, the superconducting electrical system 100 itself is part of an LNG facility that may have additional power generation units, that is, power generating components such as the source of mechanical energy 110, the generator 120, the transmission line 10, and the transformer 130.

All of the superconducting electrical components must be maintained at cryogenic temperatures. The superconducting components may be, for example, the generator 120, the motors 145, 165, 185, the transmission lines 30, 40, 50, and the transformers 130, 150, 170, 190. The superconducting components are cooled by means of a circulated refrigerant. In the drawings discussed below, the superconducting components are together identified schematically at Box 1000. In addition, in the drawings discussed below an incoming refrigerant line for cooling the components 1000 is shown at 1010, while an outgoing warmed refrigerant line is seen at 1020.

Figure 2:
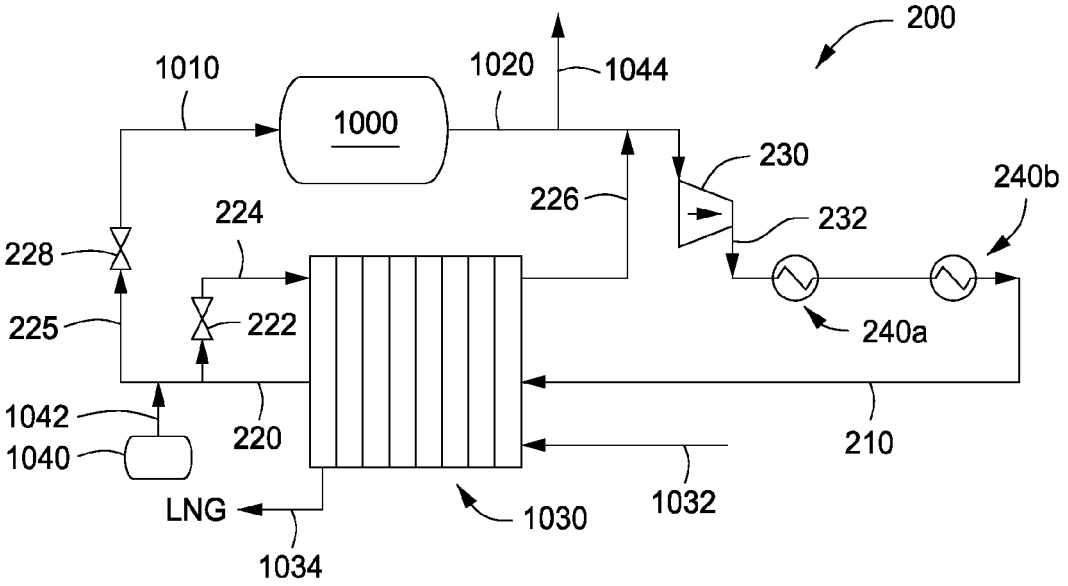
FIG. 2 is a schematic view of a refrigeration process for a natural gas liquefaction facility, in one embodiment. Here, the refrigerant used for cooling the sub-cooled natural gas in a primary LNG heat exchanger is also used for cooling the superconducting electrical components.

FIG. 2 presents a schematic view of a first refrigerant process for a natural gas liquefaction facility 200, in one embodiment. Superconducting electrical components are seen at Box 1000. The electrical components 1000 are integrated with the facility 200, or LNG processing plant, to generate or distribute electrical power.

In the facility 200 of FIG. 2, a large refrigeration unit 1030 is first seen. Examples of a suitable refrigeration unit include a brazed aluminum plate fin-type heat exchanger, a set of parallel shell-and-tube heat exchangers, or a spiral wound-type heat exchanger. Natural gas enters the refrigeration unit 1030 through gas feed line 1032. Optionally, the natural gas in feed line 1032 has already been pre-cooled in one or more cooling exchangers with ambient mediums (not shown). In addition, additional pre-cooling of the natural gas in feed line 1032 may be provided through one or more early stage refrigeration units (not shown). Thus, the refrigeration unit 1030 may simply be the last or coldest heat exchanger in the liquefaction process for the facility 200. In some cases, the refrigeration unit 1030 may be the only refrigeration unit.

The chilled natural gas leaves the refrigeration unit 1030 as a cold, liquefied natural gas, or LNG. The LNG leaves the liquefaction facility 200 through LNG line 1034. In one embodiment, the LNG in line 1034 is at about −260° F. The LNG typically exits at the coldest point of the refrigeration unit 1030. Alternatively, the LNG may exit at an intermediate point of the refrigeration unit 1030. The LNG is ultimately moved to insulated storage tanks on a transoceanic vessel or to an insulated tanker truck for transportation to natural gas markets. However, those of ordinary skill in the art will understand that the LNG will, in some cases, require further processing. For example, a pressure drum (such as drum 652 shown in FIG. 6) may be employed for final cooling and for generating an "end flash" gas that may be used as a feed gas or fuel.

A refrigerant is used for cooling the sub-cooled natural gas in the refrigeration unit 1030. The refrigerant may include a component hydrocarbon such as methane, ethane, ethylene, propane, propylene, a butane, a pentane, or a mixture of these components. Alternatively or in addition, the refrigerant may comprise nitrogen. The refrigerant is introduced into the refrigeration unit 1030 through line 210. At this stage, the refrigerant is typically cooled to an ambient temperature of about 120° F. However, further pre-cooling using propane may be applied in order to pre-chill the refrigerant in line 210 down to a lower temperature, such as about −40° F.

The refrigerant from line 210 is circulated through the refrigeration unit 1030. A refrigerant circulation line is shown at 220. While the circulation line 220 is shown external to the refrigeration unit 1030, it is understood that line 220 may be within or immediately next to the refrigeration unit 1030 for circulating the refrigerant as a working fluid. Because of circulation through the refrigeration unit 1030, the working fluid in line 220 is chilled down to, in one embodiment, about −150° F.

A majority of the working fluid in circulation line 220 may be passed through an expansion valve 222. This serves to further cool the working fluid. As an alternative, a hydraulic turbine or a gas expander may be used in place of expansion valve 222. In any instance, the further cooled working fluid is moved through line 224. The further cooled working fluid in line 224 is, in one embodiment, about −270° F. The further cooled working fluid in line 224 is circulated back into the refrigeration unit 1030 for further heat exchanging with the natural gas from line 1032 and the warm refrigerant from line 210. Recycling the working fluid through line 224 provides a conservation of cooling energy for the liquefaction process.

A warm, low-pressure refrigerant exits the refrigeration unit 1030. This is seen at warm refrigerant stream 226. This represents the fully heat-exchanged refrigerant. In one embodiment, such as where the initial refrigerant from line 210 is not pre-cooled, the refrigerant is at a temperature of about 100° F. Where the refrigerant is pre-cooled with propane, the temperature of the warmed refrigerant in line 226 may be about −60° F. The refrigerant is then moved through a compressor 230 for recompression.

Those of ordinary skill in the art will understand that in alternative refrigeration processes, the refrigeration unit 1030 could be broken up into several heat exchange services wherein heat is exchanged between the incoming natural gas from line 1032 and the pre-cooled refrigerant 210 in separate sequential or parallel services.

En route to the compressor 230, the refrigerant in line 226 preferably merges with refrigerant leaving the superconducting electrical components 1000 through line 1020. In the arrangement of FIG. 2, the refrigerant in line 1020 is the same as the refrigerant in line 210. In one embodiment, the temperature of the refrigerant in line 1020 is about −320° F. up to about −240° F.

Those of ordinary skill in the art will understand that it is more efficient to merge fluid lines having similar temperatures. The refrigerant in line 1020 is much cooler than the warmed refrigerant in line 226. Therefore, it is preferable that the refrigerant in line 1020 actually be routed back through the refrigeration unit 1030 before it is merged with the warmed refrigerant in line 226. For example, the refrigerant in line 1020 may be merged with the cooled working fluid at line 224. This allows the system 100 to take advantage of the cooling energy available from the refrigerant in line 1020. As an alternative, the refrigerant in line 1020 may be dropped to a lower pressure than the refrigerant in line 226 due to the need to reach a colder temperature for the superconducting components. Therefore, prior to merging with the warmed refrigerant in line 226, line 1020 may feed a compressor (not shown) to equalize the pressure.

As noted, the warmed refrigerant from line 226 is delivered to a compressor 230. The compressor 230 could be driven by an electric motor. The motor (not shown) has a shaft that turns a shaft or other mechanical part in the compressor 230. The motor (not shown) may be one of the superconducting electrical components of Box 1000.

Upon exiting the compressor 230, the refrigerant moves through line 232 and is delivered to a heat exchanger **240*a* for cooling. Heat exchanger 240*a* may use an ambient medium for cooling. As noted, the refrigerant is typically cooled to a temperature of about 120 F. Preferably, the refrigerant is further passed through a second heat exchanger 240*b*. As noted, further pre-cooling with another refrigeration system chills the refrigerant. In the case of a propane refrigerant system, the refrigerant from line 232 may be chilled down to a lower temperature, such as about −40° F. The cold refrigerant stream 210** is thus reproduced.

Referring back to the refrigerant in line 220, a portion of the partially cooled refrigerant is reserved as a slip stream 225. The temperature of the refrigerant in slip stream 225 is the same as that of the refrigerant in line 220, that is, about −150° F. The slip stream 225 is passed through an expansion valve 228 to further cool the refrigerant. As an alternative, a hydraulic turbine or a gas expander may be used in place of expansion valve 228. In any instance, the further cooled refrigerant becomes incoming refrigerant line 1010 that is used for cooling the superconducting electrical components 1000. The refrigerant in line 1010 must be cooled below the critical temperature for the superconducting components. In one embodiment, the expansion valve 228 (or other cooling device) chills the refrigerant for incoming refrigerant line 1010 down to about −320° F.

It can be seen that in the liquefaction facility 200, the refrigerant used for chilling the natural gas from line 1032 is also the refrigerant used in incoming refrigerant line 1010 for cooling the superconducting components 1000. This also provides a ready and inexpensive source of coolant for the superconducting electrical components 1000.

It is understood that the cooling process shown in FIG. 2 requires the superconducting components 1000 to have a critical temperature that is above the temperatures achievable with expansion of the LNG refrigerant stream 225. As such, a nitrogen-based refrigerant may be the most applicable in the facility 200 of FIG. 2.

In one embodiment, the facility 200 includes a separator, such as a gravitational separator or a hydrocyclone (not shown). The separator is employed when the refrigerant is a blend of materials. The separator is placed along line 224 to separate lighter components such as nitrogen and methane from other refrigerant components such as ethane or heavier hydrocarbons. The lighter components may then be sent through line 225 as part or even all of a dedicated refrigerant for the superconducting electrical components 1000.

It is noted that during start-up, some initial cooling of the superconducting components 1000 may be required. This allows the electrical system 100 to fully function before the LNG refrigeration system 200 is started. This problem may be solved by providing a storage tank 1040 for holding a source of refrigerant. The refrigerant from tank 1040 is delivered to the electrical components 1000 through line 1042 as an external cooling stream.

The initial working fluid used as the refrigerant from tank 1040 may be of the same type as the refrigerant used during regular operations for continuous cooling of the superconducting components. Alternatively, a different composition may be used. Liquid nitrogen is a preferred refrigerant for this purpose. The initial working fluid may need to be removed from the facility 200 to an appropriate disposition through exit line 1044. Disposition may include use as fuel gas on-site. In the case of nitrogen or helium, the materials could simply be vented. In the case of light hydrocarbons, the materials could be flared.

In one aspect, the temperature of the initial working fluid carried through line 1042 is warmer than the temperature of the later LNG slip stream 225. The warmer temperature of the initial working fluid would nevertheless be cold enough to pre-cool the electrical components 1000 so as to substantially reduce their electrical resistance before continuous cooling with the colder LNG. For example, the temperature of the initial working fluid carried through line 1042 may be about −100° F.

Figure 3:
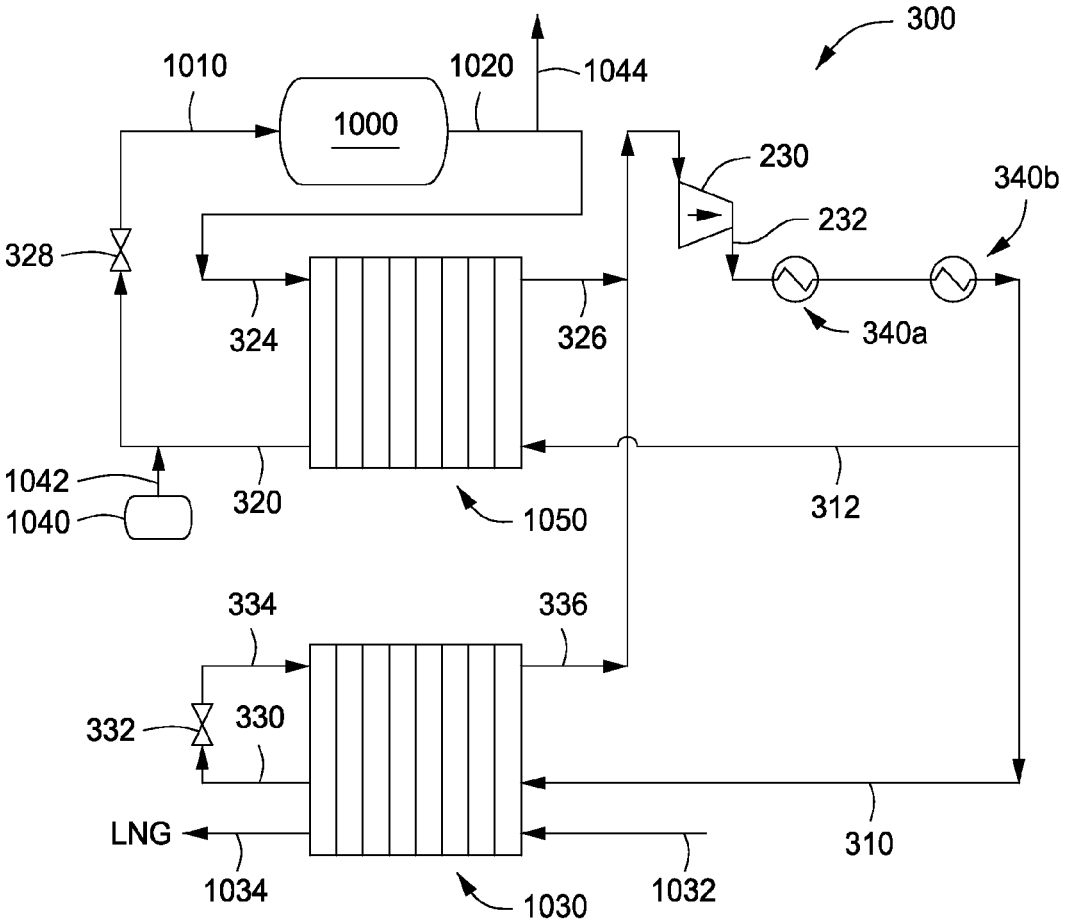
FIG. 3 is a schematic view of a refrigeration process for a natural gas liquefaction facility, in another embodiment. Heat exchangers for the natural gas liquefaction and the superconducting component chilling are separated for ease of control and design. The refrigerant used for cooling the sub-cooled natural gas in the primary LNG heat exchanger is again also used for cooling the superconducting electrical components.

FIG. 3 describes an alternate version of the gas processing facility in FIG. 2. FIG. 3 is another schematic view of a refrigerant process for a natural gas liquefaction facility 300. The facility 300 shares many of the components as facility 200. For example, superconducting electrical components are again seen at Box 1000. The electrical components 1000 are integrated with the facility 300 to provide operating power.

A large refrigeration unit 1030 is again seen. Natural gas enters the refrigeration unit 1030 through gas feed line 1032. Preferably, the natural gas in feed line 1032 has already been pre-cooled in one or more cooling towers or through one or more early-stage refrigeration units (not shown). Thus, the refrigeration unit 1030 may represent the last or coldest heat exchanger in the liquefaction process.

The chilled natural gas leaves the refrigeration unit 1030 as a cold, liquefied natural gas, or LNG. The LNG leaves the liquefaction facility 300 through LNG line 1034. In one embodiment, the LNG in line 1034 is at about −260° F. The LNG is ultimately moved to insulated storage tanks on a trans-oceanic vessel for transportation to natural gas markets. Again, however, the LNG may be further processed through a pressure let-down drum (not shown) for "end flash" of the LNG.

A refrigerant is used for cooling the sub-cooled natural gas in the refrigeration unit 1030. The refrigerant may be a pure component hydrocarbon such as methane, ethane, ethylene, propane, pentane, or a mixture of these components. For the facility 300, nitrogen is preferably used as a substantial portion of a blend. The refrigerant is introduced into the refrigeration unit 1030 through line 310. At this stage, the refrigerant is typically cooled to an ambient temperature of about 120° F. However, further pre-cooling may be applied in order to pre-chill the refrigerant in line 310. In the case of a propane refrigerant system, the refrigerant from line 310 may be chilled down to about −40° F.

The refrigerant from line 310 is circulated through the refrigeration unit 1030. The purpose is to provide heat exchange with the pre-cooled natural gas from line 1032. A refrigerant circulation line is shown at 330. While the line 330 is shown external to the refrigeration unit 1030, it is understood that line 330 may be within or immediately next to the refrigeration unit 1030 for circulating the refrigerant as a working fluid. Because of circulation through the refrigeration unit 1030, the working fluid in line 330 is chilled down to, in one embodiment, about −150° F. As in FIG. 2, the cooling of the natural gas in line 1032 and of the warm refrigerant from line 310 may be accomplished in sequential or parallel heat exchange services.

In the facility 300 of FIG. 3, the working fluid in line 330 is entirely passed through an expansion valve 332. This serves to further cool the working fluid. As an alternative, a hydraulic turbine or a gas expander may be used in place of expansion valve 332. In any instance, the further cooled working fluid is moved through line 334, and back fully into the refrigeration unit 1030 for further heat exchanging with the natural gas from gas line 1032 and the natural gas from line 210. The slip stream 225 of FIG. 2 is not employed.

A warm, low-pressure refrigerant exits the refrigeration unit 1030. This is seen at warm refrigerant stream 336. This represents the fully heat-exchanged refrigerant. In one embodiment, such as where the initial refrigerant from line 310 is not pre-cooled, the refrigerant is at a temperature of about 100° F. Where the refrigerant is pre-cooled, the temperature of the warmed refrigerant in line 336 may be about −60° F. The refrigerant is then moved through a compressor 230 for recompression.

En route to the compressor 230, the refrigerant in line 336 preferably merges with refrigerant leaving the superconducting electrical components 1000 through line 326. In one embodiment, the temperature of the refrigerant in line 326 is approximately the same as that of line 226.

In order to cool the superconducting electrical components 1000, a portion of the refrigerant from line 310 is taken. Line 312 demonstrates an LNG slip stream taken from line 310. The LNG slip stream 312 is directed into a second refrigeration unit 1050. The refrigerant from line 312 is circulated through the second refrigeration unit 1050 for cooling.

The refrigerant from line 312 is circulated through the second refrigeration unit 1050. The refrigerant is routed through line 320. The working fluid in line 320 may be passed through an expansion valve 328. As an alternative, a hydraulic turbine or a gas expander may be used in place of expansion valve 328. This serves to further cool the working fluid. The further cooled working fluid is moved through line 1010 to cool the superconducting components 1000. The further cooled working fluid in line 328 is, in one embodiment, about −320° F.

The refrigerant exist the superconducting components through line 1020. The refrigerant in line 1020 is reintroduced to the second refrigeration unit 1050 to provide cooling to the working fluid. A warm, low-pressure refrigerant then exits the second refrigeration unit 1050. This is seen at warm refrigerant stream 326. The warm refrigerant is then moved through the compressor 230 for recompression. En route to the compressor 230, the refrigerant in line 326 preferably merges with refrigerant leaving the superconducting electrical components 1000 through line 1020. In addition, the warm refrigerant in line 326 merges with warm refrigerant from line 336.

Those of ordinary skill in the art will understand that it is more efficient to merge fluid lines having similar temperatures. The refrigerant in lines 326 and 336 will have similar, though not necessarily identical, temperatures, being about −60° F. all the way up to about 100° F. In some instances, the refrigerant in line 326 will be of a lower pressure than the refrigerant in line 336. The fluid in line 326 may therefore require compression in a booster compressor (not shown) before merging with line 336.

As noted, the warmed refrigerant from lines 326 and 336 is delivered to a compressor 230. The compressor 230 may be driven by an electric motor. The motor (not shown) has a shaft that turns a shaft or other mechanical part in the compressor 230. The motor (not shown) is one of the superconducting electrical components of Box 1000.

Upon exiting the compressor 230, the combined refrigerant from lines 326 and 336 moves through line 232 and is delivered to a heat exchanger 340*a* for cooling. Heat exchanger 240*a* may use an ambient medium for cooling. Preferably, the refrigerant is further passed through a second heat exchanger 340*b* where the refrigerant is cooled by another refrigeration unit, for example, down to about −40° F. in the case of propane. The cold refrigerant stream 310 and the slip stream 312 are thus reproduced.

It can be seen that in the liquefaction facility 300, the refrigerant used for chilling the LNG is again used for chilling the superconducting electrical components 1000. However, in the system 300, the heat exchanger 1030 for the natural gas liquefaction is separated from the heat exchanger 1050 used for the superconducting component chilling. Such an arrangement is advantageous due to the large difference in refrigeration duties required between the two functions. The use of two refrigeration units 1030, 1050 facilitates design, control and operation.

Figure 4:
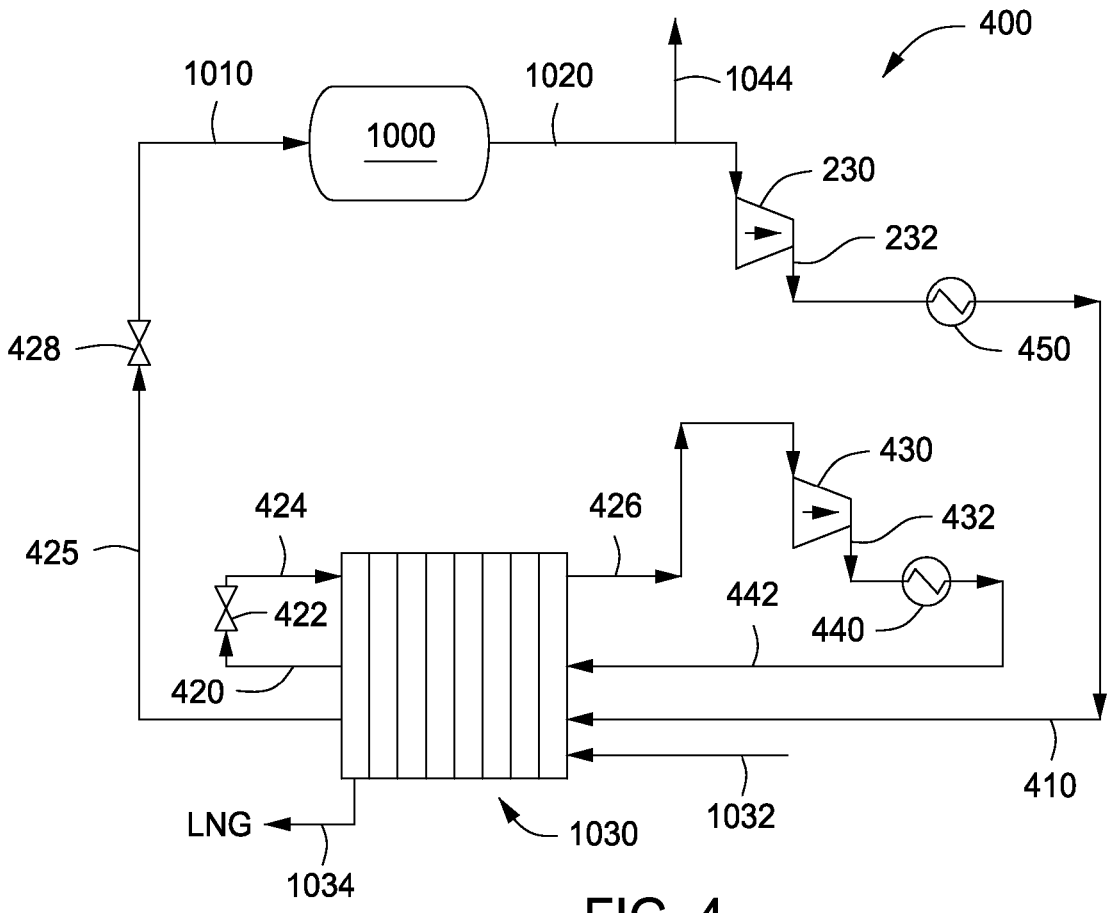
FIG. 4 is a schematic view of a refrigeration process for a natural gas liquefaction facility, in yet another embodiment. Here, the refrigerant used for cooling the sub-cooled natural gas is in a loop independent of the refrigerant used for cooling the superconducting electrical components.

FIG. 4 presents a schematic view of a refrigerant process for a natural gas liquefaction facility 400, in yet another embodiment. The facility 400 shares many of the components of facility 200. For example, superconducting electrical components are again seen at Box 1000. The electrical components 1000 are integrated with the facility 400 to provide operating power.

A large refrigeration unit 1030 is again seen. Natural gas enters the refrigeration unit 1030 through gas feed line 1032. Preferably, the natural gas in feed line 1032 has already been pre-cooled in one or more cooling towers or through one or more early-stage refrigeration units (not shown). Thus, the refrigeration unit 1030 may represent the last or coldest heat exchanger in the liquefaction process.

The chilled natural gas leaves the refrigeration unit 1030 as a cold, liquefied natural gas, or LNG. The LNG leaves the liquefaction facility 400 through LNG line 1034. In one embodiment, the LNG in line 1034 is at about −260° F. The LNG is ultimately moved to insulated storage tanks on a trans-oceanic vessel for transportation to natural gas markets. Alternatively, insulated, over-the-road tankers may be loaded. Alternatively still, the LNG may be further processed through a pressure let-down tank (not shown) for "end flash" of the LNG and for additional chilling.

A refrigerant is used for cooling the sub-cooled natural gas in the refrigeration unit 1030. The refrigerant may be pure nitrogen, or may be a pure or mixed hydrocarbon refrigerant, helium, or other low-temperature boiling point gas. The refrigerant is introduced into the refrigeration unit 1030 through line 442. At this stage, the refrigerant is typically cooled to an ambient temperature of about 120° F. However, further pre-cooling may be applied in order to pre-chill the refrigerant in line 442. In the case of a propane refrigerant system, the refrigerant in line 442 may be chilled down to a lower temperature of about −40° F.

The refrigerant from line 442 is circulated through the refrigeration unit 1030. The purpose is to provide heat exchanging with the pre-cooled natural gas from line 1032. A refrigerant circulation line is shown at 420. While the line 420 is shown external to the refrigeration unit 1030, it is understood that line 420 may be within or immediately next to the refrigeration unit 1030 for circulating the refrigerant as a working fluid. Because of circulation through the refrigeration unit 1030, the working fluid in line 420 is chilled down to, in one embodiment, about −150° F.

In the facility 400 of FIG. 4, the working fluid in line 420 is entirely passed through an expansion valve 422. This serves to further cool the working fluid. As an alternative, a hydraulic turbine or a gas expander may be used in place of expansion valve 422. In any instance, the further cooled working fluid is moved through line 424, and back fully into the refrigeration unit 1030 for further heat exchanging with the natural gas from gas line 1032 and the original refrigerant from line 442. As in FIG. 2, the cooling of the natural gas in line 1032 and of the warm refrigerant from line 442 may be accomplished in sequential or parallel heat exchange services.

A warm, low-pressure refrigerant exits the refrigeration unit 1030. This is seen at warm refrigerant stream 426. This represents the fully heat-exchanged refrigerant. In one embodiment, such as where the initial refrigerant from line 410 is not pre-cooled, the refrigerant in refrigerant stream 426 is at a temperature of about 100° F. Where the refrigerant from line 410 is pre-cooled with propane, the temperature of the warmed refrigerant in stream 426 may be about −60° F. The refrigerant in stream 426 is then moved through a compressor 430 for recompression. In the facility 400 of FIG. 4, the warm refrigerant stream 426 is not merged with the refrigerant leaving the superconducting electrical components 1000 through line 1020, as is done in facilities 200 and 300.

The warm refrigerant stream 426 exits the compressor 430 through line 432. The working fluid in line 432 may be further cooled by passing through a heat exchanger 440. Heat is rejected from a cooling circuit within the heat exchanger 440, preferably to an ambient medium. The chilled working fluid then passes into the refrigeration unit 1030 through line 442. As before, the initial refrigerant from line 410 may be further pre-cooled, for example with propane refrigeration to −40° F.

In order to cool the superconducting electrical components 1000, an independent refrigerant stream is used. This is shown at line 425. This means that a slip stream of the refrigerant is not used as is done in facilities 200 and 300. The composition of the independent refrigerant is different from the composition of the working fluid in line 442.

The independent refrigerant in line 425 is passed through the expansion valve 428 to further cool the refrigerant in line 425. A hydraulic turbine or a gas expander may be used in place of expansion valve 428. In any instance, the cooled independent refrigerant becomes incoming refrigerant line 1010 that is used for cooling the superconducting electrical components 1000. The temperature of the refrigerant in incoming line 1010 is about −320° F. The incoming refrigerant may optionally be in a mixed liquid and vapor phase.

The independent refrigerant exits the electrical power system 1000 as line 1020. The independent refrigerant is now in a warmed and vaporized condition, having been heat exchanged with the superconducting electrical components 1000. The independent refrigerant is at a temperature of about −320° F. up to about −240° F. The independent refrigerant in line 1020 is taken through a compressor 230. The compressed refrigerant or working fluid exits the compressor 230 at line 232. In some embodiments, the independent refrigerant may be passed back through refrigeration unit 1030 to provide additional cooling before being fed into the compressor 230.

The working fluid is next cooled by passing through a heat exchanger 450. Heat is rejected from a cooling circuit within the heat exchanger 450. The working fluid may be cooled by an ambient medium or intermediate temperature refrigerant depending upon the LNG liquefaction process. The cold refrigerant stream 410 is thus reproduced. In some cases, the heat exchanger 440 may be bypassed altogether if the temperature of the working fluid in line 232 is less than that of the refrigerant in line 442.

It can be seen that in the liquefaction facility 400, the cooling stream 1010 for the superconducting electrical components 1000 is physically separate from the LNG stream 1034. Stated another way, the refrigerant used for cooling the sub-cooled natural gas from line 1032 is in a loop independent of the refrigerant used for cooling the superconducting electrical components 1000. The cooling stream 1010 used for cooling the superconducting electrical components 1000 may or may not have the same composition as the refrigerant 410 used for cooling the pre-cooled natural gas in gas feed line 1032. However, the cooling stream 1010 does share the LNG refrigeration from refrigeration unit 1030. The independent refrigerant and compressor allow flexibility in setting the composition and pressure, and therefore temperature, of the independent refrigerant. This allows the independent refrigerant temperature to be controlled so as to maintain it below the critical temperature of the superconducting components regardless of the requirements of the independent refrigerant.

The facility 400 of FIG. 4 is particularly beneficial where the superconducting components 1000 need liquid nitrogen temperatures to cool below the critical temperature, but the selected LNG process has no large nitrogen refrigerant loop.

As in FIG. 3, the refrigeration unit 1030 may be separated into independent parallel heat exchangers for better design, control and operation of the LNG and superconducting component chilling. In such an embodiment, the fluid in line 442 would be split and then directed to the parallel exchangers. The warm refrigerant streams from the parallel heat exchangers would then be recombined to form warmed refrigerant stream 426 before compressor 430.

Figure 5:
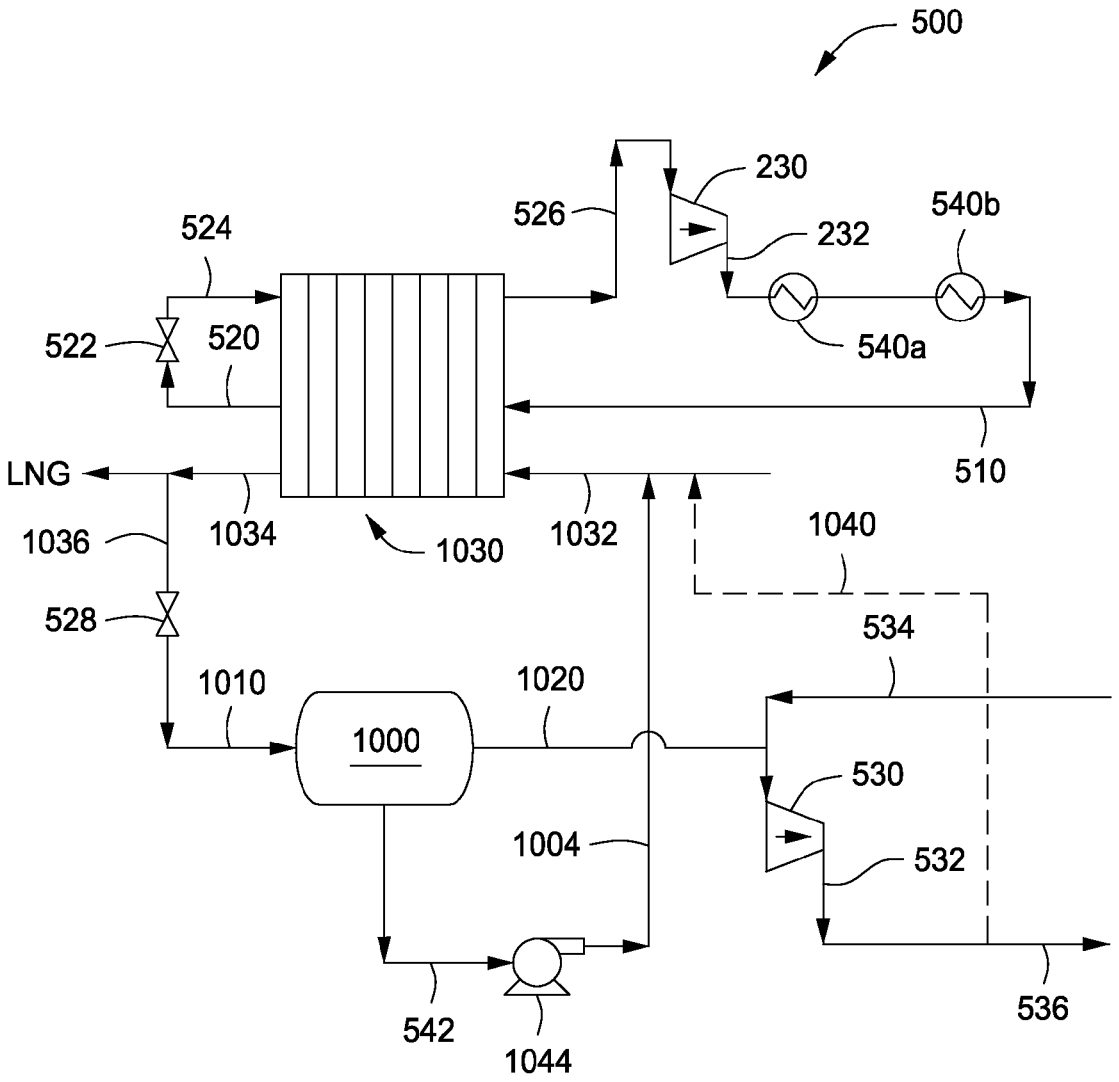
FIG. 5 is a schematic view of a refrigeration process for a natural gas liquefaction facility, in still another embodiment. Here, the LNG product itself is used for cooling the superconducting electrical components.

Yet another arrangement for the integration of superconducting electrical components into an LNG processing plant is provided in FIG. 5. FIG. 5 is a schematic view of a gas processing facility 500 in an alternate embodiment. The facility 500 shares many of the components of facility 200. For example, superconducting electrical components are again seen at Box 1000. The electrical components 1000 are integrated with the facility 500 to provide operating power.

A large refrigeration unit 1030 is again seen. Natural gas enters the refrigeration unit 1030 through gas feed line 1032. Preferably, the natural gas in feed line 1032 has already been pre-cooled in one or more cooling towers or through one or more early-stage refrigeration units (not shown). Thus, the refrigeration unit 1030 may represent the last or coldest heat exchanger in the liquefaction process.

The chilled natural gas leaves the refrigeration unit 1030 as a cold, liquefied natural gas, or LNG. The LNG leaves the liquefaction facility 500 through LNG line 1034. The LNG is ultimately moved to insulated storage tanks on a transoceanic vessel for transportation to natural gas markets. Again, however, the LNG may be further processed through a pressure let-down drum (not shown) for "end flash" of the LNG.

A refrigerant is used for further cooling the natural gas in the refrigeration unit 1030. The refrigerant may be a pure component hydrocarbon such as methane, ethane, ethylene, propane, butane, or a mixture of these components. Nitrogen may also be used in a blend. The refrigerant is introduced into the refrigeration unit 1030 through line 510. At this stage, the refrigerant is typically cooled to an ambient temperature of about 120° F. However, further pre-cooling may be applied in order to pre-chill the refrigerant in line 510. In the case of a propane refrigerant system, the refrigerant may be pre-chilled down to about −40° F.

The refrigerant from line 510 is circulated through the refrigeration unit 1030. The purpose is to provide heat exchanging with the pre-cooled natural gas from line 1032 and to further cool the refrigerant in line 510. A refrigerant circulation line is shown at 520. While the line 520 is shown external to the refrigeration unit 1030, it is understood that circulation line 520 may be within or immediately next to the refrigeration unit 1030 for circulating the refrigerant as a working fluid. Because of circulation through the refrigeration unit 1030, the working fluid in line 520 is chilled down to, in one embodiment, about −150° F.

In the facility 500 of FIG. 5, the working fluid in refrigerant circulation line 520 is entirely passed through an expansion valve 522. This serves to further cool the working fluid. As an alternative, a hydraulic turbine or a gas expander may be used in place of expansion valve 522. In any instance, the further cooled working fluid is moved through line 524, and back fully into the refrigeration unit 1030 for further heat exchanging with the natural gas from gas line 1032 and the refrigerant from line 510. The slip stream 225 of FIG. 2 is not employed. As in FIG. 2, the cooling of the natural gas from line 1032 into LNG and the cooling of the warm refrigerant from line 410 could be in separate heat exchange services.

A warm, low-pressure refrigerant exits the refrigeration unit 1030. This is seen at warm refrigerant stream 526. This represents the fully heat-exchanged refrigerant. In one embodiment, such as where the initial refrigerant from line 510 is not pre-cooled, the refrigerant is at a temperature of about 100° F. Where the refrigerant is pre-cooled, the temperature of the warmed refrigerant in line 526 may be about −60° F. The refrigerant in warm refrigerant stream 526 is then moved through a compressor 230 for recompression.

Upon exiting the compressor 230, the refrigerant moves through line 232 and is delivered to a heat exchanger **540*a* for cooling. Heat exchanger 540*a* may use an ambient medium for cooling. Preferably, the refrigerant is further passed through a second heat exchanger 540*b*. The cold refrigerant stream 510** is thus reproduced.

In order to cool the superconducting electrical components 1000, a slip stream of liquefied natural gas is taken from LNG line 1034. The slip stream is seen at line 1036. The slip stream in line 1036 is substantially in liquid phase, but typically has a mixed gaseous phase as well. In one embodiment, the LNG in slip stream 1036 is at −260° F.

The slip stream in line 1036 is preferably taken through an expansion valve 528. Alternatively, a hydraulic turbine or a gas expander may be used in place of expansion valve 528. The result is further cooling of the LNG slip stream in line 1036. The chilled LNG is directed to incoming refrigerant line 1010 and is used for cooling the superconducting electrical components 1000.

In the facility 500 of FIG. 5, the refrigerant in incoming refrigerant line 1010 cools the superconducting components 1000, and then exits as an outgoing warmed refrigerant line 1020. The warmed refrigerant constitutes a vaporized natural gas again, and is at about −250° F. The warmed refrigerant merges with other low-pressure cryogenic natural gas streams incoming at line 534. The merged stream is directed into a compressor 530 where it is pressurized before the refrigerant is then released through line 532. The low pressure cryogenic natural gas streams may be, for example, end-flash gas that is displaced from the tanks during loading of an LNG tanker, or gas that has boiled off from a LNG storage tank.

The natural gas in line 1040 is optionally returned to the primary LNG refrigeration unit 1030. In addition, a portion of the warmed gas in line 532 may be directed through line 536 and used for fuel gas at the natural gas liquefaction facility 500.

It is noted that in the facility arrangement 500 of FIG. 5, heavier hydrocarbon components from the natural gas may accumulate in liquid form as the superconducting components 1000 are cooled. Heavy hydrocarbons could otherwise cause a rise in the refrigerant temperature above the critical temperature of the superconducting components. These heavier hydrocarbon components may be gravity-separated as liquid and collected in line 1002 to remove any build-up. The accumulated heavier hydrocarbon liquids in line 1002 can then be pressurized in pump 1044 and reintroduced to the heat exchanger 1030 by merging line 1004 with the natural gas stream 1032.

As can be seen in FIG. 5, in the facility 500 a portion of the LNG product from LNG line 1034 is used as the cooling fluid 1010 for the superconducting electrical components 1000. Instead of circulating the cooling fluid immediately through the compressor 230 and back to the refrigeration unit 1030, the cooling fluid in line 1020 is sent to a separate compressor 530 and merged with the various low-pressure cryogenic gas streams in line 534. The warmed refrigerant (which is a natural gas product now vaporized) in line 1020 and the low pressure cryogenic gasses are merged into line 536. The combined natural gas may be used for fuel in firing, for example, the large power-generating turbine 110 of FIG. 1.

In some instances, excess natural gas may be delivered through line 536. This means that the LNG liquefaction plant does not need all of the fuel gas provided by line 536. In this circumstance, the excess natural gas may be returned to the refrigeration unit 1030. This is shown in line 1040. In some cases, line 1040 may pass through heat exchanger 1030 before merging with line 1032 such as shown in line 654 in FIG. 6.

The facility 500 takes advantage of the liquefied natural gas for cooling the superconducting electrical components 1000. This is particularly beneficial where the LNG is sufficiently cold to chill below the critical temperature for the superconducting material.

Figure 6:
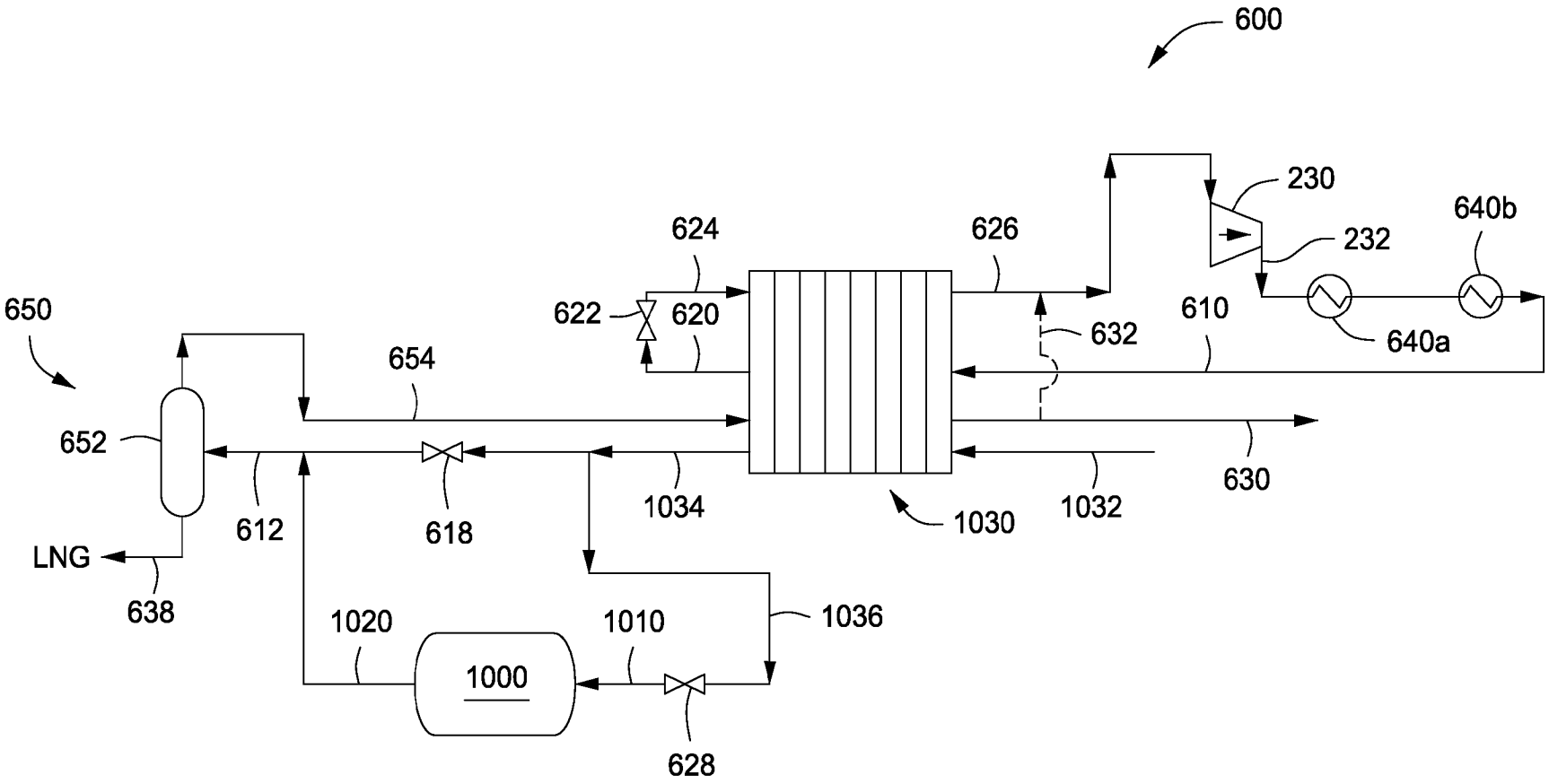
FIG. 6 is a schematic view of a refrigeration process for a natural gas liquefaction facility, in yet another embodiment. Here, the sub-cooled LNG itself is used as a refrigerant for cooling the superconducting components. The LNG return from the superconducting components is merged into an end-flash drum, and end-flash gas is returned to the primary refrigeration unit.

Another arrangement for the integration of superconducting electrical components into an LNG processing plant is provided in FIG. 6. FIG. 6 is a schematic view of a gas processing facility 600 in an alternate embodiment. The facility 600 shares many of the components of facility 500. For example, superconducting electrical components are again seen at Box 1000. The electrical components 1000 are integrated with the facility 500 to provide operating power.

A large refrigeration unit 1030 is again seen. Natural gas enters the refrigeration unit 1030 through gas feed line 1032. Preferably, the natural gas in feed line 1032 has already been pre-cooled in one or more cooling towers or through one or more early-stage refrigeration units (not shown). Thus, the refrigeration unit 1030 may represent the last or coldest heat exchanger in the liquefaction process.

The chilled natural gas leaves the refrigeration unit 1030 as a cold, liquefied natural gas, or LNG. The LNG leaves the liquefaction facility 600 through LNG line 1034. In the facility 600 of FIG. 6, the liquefied natural gas in product line 1034 is directed to an end-flash system 650. The end flash system 650 is not atypical for LNG production processes. As part of the end-flash system 650, the LNG product in line 1034 is preferably first carried through an expansion device 618. The expansion device 618 may be, for example, a valve or hydraulic turbine. The expansion device 618 further cools the LNG product down to, for example, −260° F. The further-cooled LNG product is then released through line 612.

The further-cooled LNG product in line 612 is delivered to a flash drum 652. It is understood that the flash drum 652 shown in FIG. 6 is merely schematic. In practice, the flash drum 652 may be a plurality of similar vessels. Line 638 is shown delivering the further-cooled LNG product from the flash drum 652.

The flash drum 652 holds the LNG product in a liquefied state pending delivery to an LNG transit vessel or, perhaps, a more permanent storage facility. The flash drum 652 is maintained at slightly above the LNG storage pressure, that is, the pressure maintained on the trans-oceanic vessel or in the more permanent storage facility.

The flash drum 652 releases the LNG product into line 638. The LNG product is at about −260° F. The LNG product is delivered through line 638 to the trans-oceanic vessel or to the more permanent storage facility.

During holding in flash drum 652, some natural gas vapors are released due to a let-down in pressure. The natural gas vapors are known as "end flash gas." The end flash gas is released through line 654. The end flash gas in line 654 is directed back to the refrigeration unit 1030 to provide additional cooling. In one embodiment, the flash gas is circulated in a dedicated line 630 for cooling within the refrigeration unit 1030, and then used as fuel gas for the LNG facility 600. In another embodiment, some or all of the gas in line 1030 may be compressed and returned to line 1032 for reliquefaction.

In order to cool the superconducting electrical components 1000, a slip stream of liquefied natural gas is taken from LNG line 1034. The slip stream is seen at line 1036, and represents a part of the LNG from line 1034 thieved before it passes through the flash drum 652 and leaves the facility 600. The slip stream in line 1036 is substantially in liquid phase, but typically has a mixed gaseous phase as well. In one embodiment, the LNG slip stream in line 1036 is at about −250° F.

The slip stream in line 1036 is preferably taken through an expansion valve 628. Alternatively, a hydraulic turbine or a gas expander may be used in place of expansion valve 628. The result is further cooling of the LNG slip stream in line 1036. In one embodiment, slip stream from line 1036 is chilled to about −260° F. The chilled LNG refrigerant is directed to incoming refrigerant line 1010 and is used for cooling the superconducting electrical components 1000.

The LNG refrigerant in incoming refrigerant line 1010 is circulated through the superconducting electrical components 1000 to maintain the superconducting materials below the critical temperature. The refrigerant then exits the superconducting components 1000 through outgoing refrigerant line 1020. Preferably, the refrigerant in the outgoing refrigerant line 1020 is merged with line 612 to feed the flash drum 652. It is important to purge both liquid and gaseous hydrocarbons through line 1020 to avoid accumulations of heavier hydrocarbons that could increase the refrigerant temperature.

A refrigerant is used for cooling the sub-cooled natural gas in the refrigeration unit 1030. The refrigerant may be a pure component hydrocarbon such as methane, ethane, ethylene, propane, pentane or a mixture of these components. Nitrogen may also be used in a blend. The refrigerant is introduced into the refrigeration unit 1030 through line 610. At this stage, the refrigerant is typically cooled to an ambient temperature of about 120° F. However, further pre-cooling may be applied in order to pre-chill the refrigerant in line 610 down to a lower temperature. Where a propane refrigerant system is used, the refrigerant may be pre-chilled down to such as about −40° F., for example.

A portion of the flash gas from line 630 may be merged with the refrigerant in line 626 for refrigerant make-up. This is indicated at line 632. Line 632 is dashed to show that this is optional, depending on the availability of other refrigerant make-up gas within the facility 600.

The refrigerant from line 610 is circulated through the refrigeration unit 1030. The purpose is to provide heat exchanging with the pre-cooled natural gas from line 1032. A refrigerant circulation line is shown at 620. While the circulation line 620 is shown external to the refrigeration unit 1030, it is understood that circulation line 620 may be within or immediately next to the refrigeration unit 1030 for circulating the refrigerant as a working fluid. Because of circulation through the refrigeration unit 1030, the working fluid in refrigerant circulation line 620 is chilled down to, in one embodiment, about −150° F.

In the facility 600 of FIG. 6, the working fluid in line 620 is entirely passed through an expansion valve 622. As an alternative, a hydraulic turbine or a gas expander may be used. In any instance, expansion serves to further cool the working fluid from line 620. The further cooled working fluid is moved through line 624, and back fully into the refrigeration unit 1030 for further heat exchanging with the natural gas from gas line 1032 and the original refrigerant from line 610.

A warm, low-pressure refrigerant exits the refrigeration unit 1030. This is seen at warm refrigerant stream 626. This represents the fully heat-exchanged refrigerant. In one embodiment, such as where the initial refrigerant from line 610 is not pre-cooled, the refrigerant in line 626 is at a temperature of about 100° F. Where the refrigerant is pre-cooled, the temperature of the warmed refrigerant in refrigerant stream 626 may be about −60° F., such as in the case of propane refrigerant pre-cooling. The warmed refrigerant is then moved through a compressor 230 for recompression.

In the facility 600 of FIG. 6, the warm refrigerant stream 626 is not merged with the refrigerant leaving the superconducting electrical components 1000 through line 1020, as is done in facilities 200 and 300. Instead, the warm refrigerant in stream 626 is directed through the compressor 230 for recompression. Upon exiting the compressor 230, the refrigerant moves through line 232 and is delivered to a heat exchanger 640*a* for cooling. Heat exchanger 640*a* may use an ambient medium for cooling. Preferably, the refrigerant is further passed through a second heat exchanger 640*b* for pre-cooling with another refrigerant, for example, propane, to approximately −40° F. The cold refrigerant stream 610 is thus reproduced.

As can be seen, the facility 600 of FIG. 6 represents another embodiment where the LNG itself is used as the cooling fluid for the superconducting components 1000. Instead of circulating the cooling fluid immediately through the compressor 230 and back to the refrigeration unit 1030, the cooling fluid is merged with the end flash gas in system 650 and sent directly back to the refrigeration unit 1030 through line 654. This, again, is advantageous in situations where the LNG in LNG product line 1034 is sufficiently cold to chill the superconducting components 1000 below the critical temperature.

The facility arrangement 600 of FIG. 6 may be modified. In one aspect, the LNG product stream 1034 may be sub-cooled below the temperature normally required to produce LNG, for example, below −270° F. The entire LNG product stream 1034 may then be directed to the superconducting components 1000 for cooling through line 1010. The warmed LNG outlet stream 1020 may then be directed to the expansion device 618 and then sent to the flash drum 652.

Figure 7:
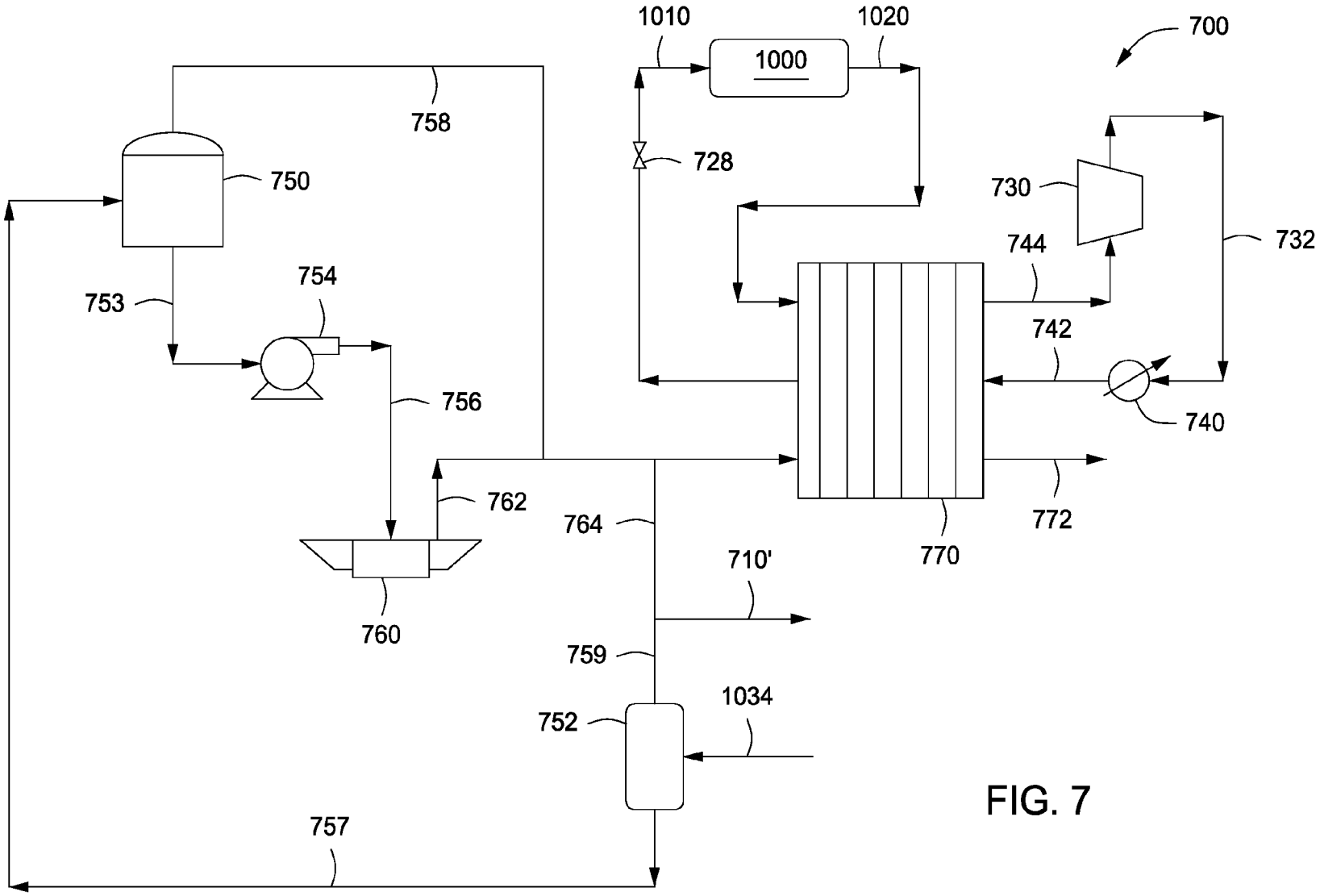
FIG. 7 is a schematic view of an ancillary refrigeration process for a natural gas liquefaction facility, in one embodiment. Here endflash gas or other cold off-gas streams from the LNG plant is used to sub-cool the refrigerant that the cools the superconducting components.

In one aspect of the present inventions, vaporized LNG may be used in the cooling of the superconducting components. FIG. 7 is a schematic view of a natural gas liquefaction facility 700, in one embodiment, where such takes place. In the facility 700, an ancillary refrigeration unit 770 is used for cooling the superconducting components. The ancillary refrigeration unit 770 takes advantage of cold methane gas that has flashed or been displaced at the liquefaction facility 700.

First, FIG. 7 shows a storage tank 750. The storage tank 750 provides temporary storage for liquefied natural gas before it is loaded onto an LNG vessel. An LNG vessel is seen at 760. A jumper line 753 is seen delivering liquefied natural gas from the storage tank 750. The LNG passes through a loading pump 754, and then passes through a loading line 756 before entering the LNG vessel 760.

As the liquefied natural gas fills LNG compartments on the LNG vessel 760, it displaces residual vapor from the LNG compartments. The residual vapor is primarily comprised of methane, with smaller amounts of nitrogen. The residual vapor is released from the LNG vessel through offloading line 762. The residual vapor from offloading line 762 is then taken through the ancillary refrigeration unit 770.

It is also noted that a separate vapor stream is provided from the storage tank 750. This is shown as an overhead flash line 758. Boil-off gas passes from the storage tank 750 and through the overhead flash line 758. The boil-off gas is then carried to the ancillary refrigeration unit 770 along with the residual vapor from the LNG vessel 760. A compressor (not shown) may optionally be provided along the overhead flash line 758 to assist the boil-off gas in merging with the residual vapor in offloading line 762.

The boil-off gas from the storage tank 750 and the residual vapors from the LNG vessel 760 represent two sources of low-pressure, cryogenic, natural gas streams for feeding into the ancillary refrigeration unit 770. The cryogenic natural gas streams provide cooling energy for the refrigerant that passes through the ancillary refrigeration unit 770.

Yet a third source of cooling energy for the ancillary refrigeration unit 770 is the end-flash gas that may flash from a drum 752. The drum 752 receives LNG from an LNG line 1034. The LNG in line 1034 is distributed by a primary refrigeration unit (not shown in FIG. 7). The flash drum 752 allows the system to step down from the high operating pressure of the primary refrigeration unit (such as 1,000 psig) to a storage pressure.

FIG. 7 shows an LNG outlet line 757 from the flash drum 752. The outlet line 757 contains liquefied natural gas. FIG. 7 also shows an overhead flash line 759. When the pressure let-down takes place in the flash drum 752, a part of the LNG vaporizes and is captured through the overhead flash line 759. A part of the cold vapor is optionally carried through line 710' to the primary refrigeration unit for re-liquefaction. However, at least some of the cold vapor is taken through line 764. Line 764 merges with lines 762 and 758, and is introduced into the ancillary refrigeration unit 770.

As the low-pressure, cryogenic, natural gas streams (lines 762, 758, 764) pass through the ancillary refrigeration unit 770, they are warmed. The natural gas streams exit the ancillary refrigeration unit 770 as a single stream through line 772. The warmed natural gas stream from line 772 is then used as fuel gas for the entire LNG facility, or recycled for reliquefaction.

Finally, a refrigeration loop is shown in FIG. 7. The refrigeration loop provides cooling for the refrigerant used to cool the superconducting electrical components 1000. It can be seen that an incoming refrigerant line 1010 is provided for cooling the components 1000, while an outgoing warmed refrigerant line is seen at 1020. An expansion valve 728 is provided to further cool the refrigerant in the incoming refrigerant line 1010. The refrigerant is looped back into the ancillary refrigeration unite 770 through line 1020.

The warmed refrigerant travels back though the ancillary refrigeration unit 770 to extract a last bit of cold energy. The refrigerant then exits through line 744 as a further-warmed refrigerant. The further-warmed refrigerant in line 744 is passed through a compressor 730, and then exits through line 732. The refrigerant is pre-cooled through a heat exchanger 740 and is then taken back to the ancillary refrigeration unit 770.

An advantage to the embodiment in FIG. 7 is that this system is small and better matches the cooling loads to maintain the superconducting components below their critical temperatures. In addition, the system can be controlled independently of the primary liquefaction system, and any upsets in the refrigeration system for the super-conducting components can be managed in the fuel system rather than disturbing the primary liquefaction process.

Various facilities have been disclosed herein which offer improved power efficiency for an LNG liquefaction process. Efficiency is improved by incorporating superconducting electrical components into the power generation for an LNG plant. The superconducting components may utilize the streams and compression services already available in the LNG plant. The use of superconducting electrical components into the power generation also reduces the capital cost for construction or expansion of an LNG plant.

The use of superconducting electrical components into the power generation also reduces the space and weight of equipment needed for LNG production. This is of particular benefit in offshore applications. In any application, the inventions disclosed herein leverage the low unit-cost refrigeration associated with LNG production to provide low-cost cooling to the superconducting components. The inventions may, in certain embodiments, further improve efficiency and reduce greenhouse gas emissions by substituting gas-driven turbines or combined cycle turbines with superconducting electrical motors, generators, transformers, electrical transmission conductors, or combinations thereof.

It is believed that the use of superconducting electrical components can improve the electrical efficiency of any electrical component of an LNG processing facility by at least one percent over what would be experienced through the use of conventional electrical components. Improving efficiency may be expressed in terms of increasing the efficiency of liquefaction of natural gas in LNG per unit power, or in LNG per unit fuel demand, or in LNG per unit emissions. Each of these measurements may be increased through the use of superconducting electrical components, the electrical components being improved by at least one percent, and preferably at least three percent over conventional electrical components.

The following Embodiments A-LL further describe the facilities provided herein:

Embodiment A

A natural gas processing facility, comprising: (a) an electrical power source, (b) a primary processing unit for warming liquefied natural gas or chilling natural gas to a temperature of liquefaction, (c) a first refrigerant inlet line for delivering a heat exchange medium to the primary processing unit; (d) a natural gas inlet line for delivering natural gas to the primary processing unit; (e) a natural gas outlet line; (f) at least one superconducting electrical component which incorporates a superconducting material so as to improve electrical efficiency of the component by at least one percent over what would be experienced through the use of non-superconducting electrical components, (g) an incoming refrigerant line for delivering a refrigerant to the at least one superconducting electrical component for maintaining the at least one superconducting electrical component below a critical temperature, and (h) an outgoing refrigerant line for releasing the refrigerant from the at least one superconducting electrical component.

Embodiment B

The natural gas processing facility of Embodiment A, wherein the facility is a natural gas liquefaction facility, the primary processing unit is a primary refrigeration unit, the heat exchange medium is a first refrigerant, and the natural gas outlet line is for releasing a substantially liquefied natural gas from the primary refrigeration unit.

Embodiment C

The natural gas processing facility of Embodiment A or B, wherein the electrical power source comprises a power grid, at least one gas turbine generator, steam turbine generator, diesel generator, or combinations thereof.

Embodiment D

The natural gas processing facility of any of Embodiments A-C, wherein the natural gas from the natural gas inlet line is pre-cooled before entry into the primary processing unit.

Embodiment E

The natural gas processing facility of Embodiment B, wherein the primary refrigeration unit is a final refrigeration unit.

Embodiment F

The natural gas processing facility of any of Embodiments A-E, wherein the at least one superconducting electrical component comprises one or more motors, one or more generators, one or more transformers, one or more switchgears, one or more variable speed drives, one or more electrical transmission conductors, or combinations thereof.

Embodiment G

The natural gas processing facility of any of Embodiments A-F, further comprising an offshore unit for supporting the facility for the liquefaction or gasification of natural gas, the offshore unit comprising, a floating vessel, a ship-shaped vessel, or a mechanical structure founded on a sea floor.

Embodiment H

The natural gas processing facility of any of embodiments A-G, wherein the superconducting electrical components (i) weigh at least about one-quarter less, or about one-third less, or about one-half less than the weight of equivalent non-superconducting components; (ii) have a footprint that is at least about one-quarter smaller, or about one-third smaller, or about one-half smaller than the footprint of equivalent non-superconducting components, or (iii) any combination thereof, including any combination of both (i) and (ii).

Embodiment I

The natural gas processing facility of any of Embodiments A-H, wherein: (a) the at least one superconducting electrical component comprises a motor for turning a shaft; and (b) the shaft turns a mechanical component of a compressor or pump for compressing or pumping a refrigerant stream or other fluid streams in the facility.

Embodiment J

The natural gas processing facility of any of Embodiments B-I, wherein the facility comprises a plurality of compressors and pumps for compressing or pumping a refrigerant stream, or other fluid streams in the facility, and the at least one superconducting electrical component comprises a plurality of motors for turning respective shafts, and the respective shafts turn corresponding mechanical components of compressors or pumps for compressing or pumping refrigerant or other fluid streams in the facility.

Embodiment K

The natural gas processing facility of any of Embodiments A-J, wherein the refrigerant for maintaining the at least one superconducting electrical component below a critical temperature comprises liquefied natural gas, methane, ethane, ethylene, propane, a butane, a pentane, nitrogen, or a mixture of these components.

Embodiment L

The natural gas processing facility of any of Embodiments B-K, further comprising a refrigerant slip line, the refrigerant slip line delivering a portion of the first refrigerant to the incoming refrigerant line used for delivering the second refrigerant to the at least one superconducting electrical component; and wherein the first refrigerant and the second refrigerant are the same refrigerant.

Embodiment M

The natural gas processing facility of any of Embodiments B-L, wherein: the facility further comprises a warmed refrigerant outlet line for releasing warmed refrigerant from the primary refrigeration unit, and a compressor for re-compressing the warmed refrigerant in the warmed refrigerant outlet line before circulation back into the primary refrigeration unit as part of the first refrigerant; and the warmed refrigerant from the warmed refrigerant outlet line is merged with the second refrigerant in the outgoing refrigerant line that is used for releasing the second refrigerant from the at least one superconducting electrical component so that the warmed refrigerant and the second refrigerant are together passed through the compressor.

Embodiment N

The natural gas processing facility of any of Embodiments B-M, further comprising: an ancillary refrigeration unit, an incoming refrigerant slip line, the incoming refrigerant slip line taking a portion of the first refrigerant from the first refrigerant inlet line and delivering the portion of the first refrigerant to the ancillary refrigeration unit as a third refrigerant; and an outgoing refrigerant slip line for delivering a portion of the third refrigerant to the incoming refrigerant line used for delivering the second refrigerant to the at least one superconducting electrical component.

Embodiment O

The natural gas processing facility of Embodiment N, wherein the third refrigerant and the second refrigerant are the same refrigerant.

Embodiment P

The natural gas processing facility of Embodiment N or O, wherein a duty of the ancillary refrigeration unit is controlled independently from the primary refrigeration unit.

Embodiment Q

The natural gas processing facility of any of Embodiments B-P, wherein: the primary refrigeration unit comprises a primary warmed refrigerant outlet line for releasing warmed refrigerant from the primary refrigeration unit; the ancillary refrigeration unit comprises an ancillary warmed refrigerant outlet line for releasing warmed refrigerant from the ancillary refrigeration unit; and a first compressor for re-compressing the warmed refrigerant in the primary warmed refrigerant outlet line before circulation back into the primary refrigeration unit.

Embodiment R

The natural gas processing facility of Embodiment Q, wherein: the warmed refrigerant in the ancillary warmed refrigerant outlet line is merged with the warmed refrigerant in the primary warmed refrigerant outlet line before the primary warmed refrigerant in the warmed refrigerant outlet line is re-compressed in the first compressor; and the warmed refrigerant in the ancillary warmed refrigerant outlet line and the warmed refrigerant in the primary warmed refrigerant outlet line are released from the first compressor as the first refrigerant.

Embodiment S

The natural gas processing facility of Embodiment Q, wherein: the second refrigerant in the outgoing refrigerant line that is used for releasing the second refrigerant from the at least one superconducting electrical component is directed into the ancillary refrigeration unit.

Embodiment T

The natural gas processing facility of Embodiment Q, wherein: the warmed refrigerant in the ancillary warmed refrigerant outlet line is passed through a second compressor, and then merged with the warmed refrigerant in the primary warmed refrigerant outlet line before the warmed refrigerant in the primary warmed refrigerant outlet line has passed through the first compressor, thereby providing independent temperature control between the ancillary and primary refrigeration units.

Embodiment U

The natural gas processing facility of any of Embodiments B-T, wherein: the facility further comprises a second outlet line for releasing an independent refrigerant from the primary refrigeration unit as the second refrigerant to the at least one superconducting electrical component; and the independent refrigerant has a composition that is different from the first refrigerant.

Embodiment V

The natural gas processing facility of Embodiment U, wherein the second refrigerant has a cooling temperature in the incoming refrigerant line that is controlled independent of the first refrigerant in the first refrigerant inlet line to ensure operation of the superconducting electrical equipment below the critical temperature.

Embodiment W

The natural gas processing facility of any of Embodiments B-V, wherein: the facility further comprises an ancillary refrigeration unit; the ancillary refrigeration unit generates the second refrigerant independent of the primary refrigeration unit; and the ancillary refrigeration unit receives at least a portion of the second refrigerant in the outgoing refrigerant line that is used for releasing the second refrigerant from the at least one superconducting electrical component as a working fluid.

Embodiment X

The natural gas processing facility of any of Embodiment W, wherein: a portion of the primary refrigerant is directed to the ancillary refrigeration unit; a primary warmed refrigerant outlet line releases warmed refrigerant from the primary refrigeration unit; a primary warmed refrigerant outlet line releases warmed refrigerant from the ancillary refrigeration unit; the outlet lines for the primary warmed refrigerant from the primary and ancillary refrigeration units are merged into a combined warm refrigerant outlet line; a first compressor is provided for re-compressing the warmed refrigerant in the combined warmed refrigerant outlet line, the warmed refrigerant in the combined warmed refrigerant outlet line being partially cooled and then circulated back into the primary refrigeration unit as the first refrigerant and the ancillary refrigeration unit; and a second compressor is provided for re-compressing the second refrigerant in the outgoing refrigerant line, the second refrigerant being partially cooled and then circulated back into the primary refrigeration unit.

Embodiment Y

The natural gas processing facility of any of Embodiments U-X, wherein the facility further comprises: a primary warmed refrigerant outlet line for releasing warmed refrigerant from the primary refrigeration unit; a first compressor for re-compressing the warmed refrigerant in the primary warmed refrigerant outlet line, the warmed refrigerant in the primary warmed refrigerant outlet line being partially cooled and then circulated back into the primary refrigeration unit as the first refrigerant; and a second compressor for re-compressing the second refrigerant in the outgoing refrigerant line, the second refrigerant being partially cooled and then circulated back into the primary refrigeration unit.

Embodiment Z

The natural gas processing facility of any of Embodiments B-Y, wherein: the second refrigerant for maintaining the at least one superconducting electrical component below a critical temperature comprises a portion of the liquefied natural gas from the natural gas outlet line; the portion of the liquefied natural gas is taken from the natural gas outlet line as a slip stream; and the slip stream is in fluid communication with the incoming refrigerant line for delivering the second refrigerant to the at least one superconducting electrical component.

Embodiment AA

The natural gas processing facility of Embodiment Z, wherein the facility further comprises: a primary warmed refrigerant outlet line for releasing warmed refrigerant from the primary refrigeration unit; a first compressor for re-compressing the warmed refrigerant in the primary warmed refrigerant outlet line, the warmed refrigerant being partially cooled and then circulated back into the primary refrigeration unit as the first refrigerant; and a second compressor for re-compressing the second refrigerant in the outgoing refrigerant line, the second refrigerant being either (i) circulated back into the primary refrigeration unit for re-chilling, (ii) used as fuel gas for the facility, or (iii) both (i) and (ii).

Embodiment BB

The natural gas processing facility of Embodiment AA, wherein: the liquefied natural gas in the natural gas outlet line comprises heavier hydrocarbons; the heavier hydrocarbons are removed from cooling lines delivering the second refrigerant to the at least one superconducting electrical component; and the removed heavier hydrocarbons are reintroduced into the natural gas inlet line.

Embodiment CC

The natural gas processing facility of Embodiment AA, wherein the second refrigerant in the outgoing refrigerant line is circulated back to the primary refrigeration unit.

Embodiment DD

The natural gas processing facility of any of Embodiments A-CC, wherein the facility further comprises: an end flash system that (i) receives the liquefied natural gas from the natural gas outlet line, (ii) temporarily stores the liquefied natural gas, (iii) delivers a substantial portion of the liquefied natural gas to a trans-oceanic vessel or more permanent on-shore storage, and (iv) releases end flash gas through an end-flash line; and wherein the second refrigerant is directed to the end-flash system after cooling the at least one superconducting electrical component.

Embodiment EE

The natural gas processing facility of Embodiment DD, wherein the end flash gas is circulated back into the primary refrigeration unit.

Embodiment FF

The natural gas processing facility of Embodiment Z, wherein the second refrigerant in the outgoing refrigerant line is merged with the end flash gas.

Embodiment GG

The natural gas processing facility of any of Embodiments B-FF, wherein: liquefied natural gas in the natural gas outlet line is sub-cooled in the primary refrigeration unit below a critical temperature of the at least one superconducting electrical component; at least a portion of the sub-cooled liquefied natural gas is used as the second refrigerant; the second refrigerant in the outgoing refrigerant line is introduced into an end flash system that (i) receives the liquefied natural gas from the outgoing refrigerant line, (ii) temporarily stores the liquefied natural gas, (iii) delivers a substantial portion of the liquefied natural gas to a trans-oceanic vessel or more permanent on-shore storage, and (iv) releases end flash gas through an end-flash line.

Embodiment HH

The natural gas processing facility of any of Embodiments A-GG, further comprising: a storage device for holding a source of refrigerant; an expansion device for cooling the source of refrigerant and releasing the source of refrigerant to the superconducting electrical components during start-up of the facility.

Embodiment II

The natural gas processing facility of any of Embodiments A-HH, further comprising: an exit line for releasing gas from the second refrigerant in the outgoing refrigerant line and (i) delivering the gas as fuel for the facility, (ii) delivering the gas back to the primary refrigeration unit for reliquefaction, or (iii) venting the gas.

Embodiment JJ

The natural gas processing facility of Embodiments AA, wherein boil-off natural gas is recovered from LNG storage tanks, from loading lines, from vapors displaced during the loading of an LNG ship, or combinations thereof, and merged with the second refrigerant outlet line before feeding the second compressor.

Embodiment KK

The natural gas processing facility of any of Embodiments A-JJ, wherein: the liquefied natural gas from the natural gas outlet line produces LNG end flash gas; and the second refrigerant is cooled by chilling in heat exchange with (i) LNG end-flash gas, (ii) gas produced from boiling of an LNG storage tank, (iii) gas produced from boil-off natural gas in loading lines, (iv) gas displaced during loading of an LNG ship, or (v) combinations thereof.

Embodiment LL

The natural gas processing facility of any of Embodiments A-KK, wherein improving electrical efficiency of the superconducting service by at least 1%, or at least 1.5%, or at least 2%, or at least 3% over what would be experienced through the use of conventional electrical components comprises increasing the efficiency of liquefaction of natural gas in terms of (i) LNG per unit power, (ii) LNG per unit fuel demand, or (iii) LNG per unit emissions.

While it will be apparent that the inventions herein described are well calculated to achieve the benefits and advantages set forth above, it will be appreciated that the inventions are susceptible to modification, variation and change without departing from the spirit thereof.

What is claimed is:

1. A natural gas liquefaction facility, comprising:

an electrical power source;

a primary refrigeration unit for chilling natural gas to a temperature of liquefaction;

a first refrigerant inlet line for delivering a first refrigerant to the primary refrigeration unit;

a natural gas inlet line for delivering natural gas to the primary refrigeration unit;

a natural gas outlet line for releasing a liquefied natural gas from the primary refrigeration unit;

at least one superconducting electrical component which incorporates a superconducting material so as to improve electrical efficiency of the component by at least one percent over what would be experienced through the use of non-superconducting electrical components;

an incoming refrigerant line for delivering a refrigerant to the at least one superconducting electrical component for maintaining the at least one superconducting electrical component below a critical temperature;

an outgoing refrigerant line for releasing the refrigerant from the at least one superconducting electrical component;

an ancillary refrigeration unit;

an incoming refrigerant slip line, the incoming refrigerant slip line taking a portion of the first refrigerant from the incoming refrigerant inlet line and delivering the portion of the first refrigerant to the ancillary refrigeration unit as a third refrigerant; and an outgoing refrigerant slip line for delivering a portion of the third refrigerant to the incoming refrigerant line used for delivering a second refrigerant to the at least one superconducting electrical component.

2. The natural gas processing facility of claim 1, wherein the electrical power source comprises a power grid, at least one gas turbine generator, steam turbine generator, diesel generator, or combinations thereof.

3. The natural gas processing facility of claim 1, wherein the natural gas from the natural gas inlet line is pre-cooled before entry into the primary processing unit.

4. The natural gas processing facility of claim 1, wherein the primary refrigeration unit is a final refrigeration unit.

5. The natural gas processing facility of claim 1, wherein the at least one superconducting electrical component comprises one or more motors, one or more generators, one or more transformers, one or more switchgears, one or more variable speed drives, one or more electrical transmission conductors, or combinations thereof.

6. The natural gas processing facility of claim 1, further comprising an offshore unit for supporting the facility for the liquefaction or gasification of natural gas, the offshore unit comprising, a floating vessel, a ship-shaped vessel, or a mechanical structure founded on a sea floor.

7. The natural gas processing facility of claim 1, wherein the superconducting electrical components (i) weigh at least about one-third less than the weight of equivalent non-superconducting components; (ii) have a footprint that is at least about one-third smaller than the footprint of equivalent non-superconducting components, or (iii) both.

8. The natural gas processing facility of claim 5, wherein:

the at least one superconducting electrical component comprises a motor for turning a shaft; and the shaft turns a mechanical component of a compressor or pump for compressing or pumping a refrigerant stream or other fluid streams in the facility.

9. The natural gas processing facility of claim 1, wherein:

the facility comprises a plurality of compressors and pumps for compressing or pumping a refrigerant stream, or other fluid streams in the facility;

the at least one superconducting electrical component comprises a plurality of motors for turning respective shafts; and the respective shafts turn corresponding mechanical components of compressors or pumps for compressing or pumping refrigerant or other fluid streams in the facility.

10. The natural gas processing facility of claim 1, wherein the refrigerant for maintaining the at least one superconducting electrical component below a critical temperature comprises liquefied natural gas, methane, ethane, ethylene, propane, a butane, a pentane, nitrogen, or a mixture of these components.

11. The natural gas processing facility of claim 10, further comprising a refrigerant slip line, the refrigerant slip line delivering a portion of the first refrigerant to the incoming refrigerant line used for delivering the second refrigerant to the at least one superconducting electrical component, and wherein the first refrigerant and the second refrigerant are the same refrigerant.

12. The natural gas processing facility of claim 11, wherein:

the facility further comprises a warmed refrigerant outlet line for releasing warmed refrigerant from the primary refrigeration unit, and a compressor for re-compressing the warmed refrigerant in the warmed refrigerant outlet line before circulation back into the primary refrigeration unit as part of the first refrigerant; and the warmed refrigerant from the warmed refrigerant outlet line is merged with the second refrigerant in the outgoing refrigerant line that is used for releasing the second refrigerant from the al least one superconducting electrical component so that the warmed refrigerant and the second refrigerant are together passed through the compressor.

13. The natural gas processing facility of claim 1, wherein the third refrigerant and the second refrigerant are the same refrigerant.

14. The natural gas processing facility of claim 1, wherein a duty of the ancillary refrigeration unit is controlled independently from the primary refrigeration unit.

15. The natural gas processing facility of claim 1, wherein:

the primary refrigeration unit comprises a primary warmed refrigerant outlet line for releasing warmed refrigerant from the primary refrigeration unit;

the ancillary refrigeration unit comprises an ancillary warmed refrigerant outlet line for releasing warmed refrigerant from the ancillary refrigeration unit; and a first compressor for re-compressing the warmed refrigerant in the primary warmed refrigerant outlet line before circulation back into the primary refrigeration unit.

16. The natural gas processing facility of claim 15, wherein:

the warmed refrigerant in the ancillary warmed refrigerant outlet line is merged with the warmed refrigerant in the primary warmed refrigerant outlet line before the primary warmed refrigerant in the warmed refrigerant outlet line is re-compressed in the first compressor; and the warmed refrigerant in the ancillary warmed refrigerant outlet line and the warmed refrigerant in the primary warmed refrigerant outlet line are released from the first compressor as the first refrigerant.

17. The natural gas processing facility of claim 15, wherein:

the second refrigerant in the outgoing refrigerant line that is used for releasing the second refrigerant from the at least one superconducting electrical component is directed into the ancillary refrigeration unit.

18. The natural gas processing facility of claim 15, wherein:

the warmed refrigerant in the ancillary warmed refrigerant outlet line is passed through a second compressor, and then merged with the warmed refrigerant in the primary warmed refrigerant outlet line before the warmed refrigerant in the primary warmed refrigerant outlet line has passed through the first compressor, thereby providing independent temperature control between the ancillary and primary refrigeration units.

19. The natural gas processing facility of claim 1, wherein:

the facility further comprises a second outlet line for releasing an independent refrigerant from the primary refrigeration unit as the second refrigerant to the at least one superconducting electrical component; and the independent refrigerant has a composition that is different from the first refrigerant.

20. The natural gas processing facility of claim 19, wherein the second refrigerant has a cooling temperature in the incoming refrigerant line that is controlled independent of the first refrigerant in the first refrigerant inlet line to ensure operation of the superconducting electrical equipment below the critical temperature.

21. The natural gas processing facility of claim 19, wherein:

the facility further comprises an ancillary refrigeration unit;

the ancillary refrigeration unit generates the second refrigerant independent of the primary refrigeration unit; and the ancillary refrigeration unit receives at least a portion of the second refrigerant in the outgoing refrigerant line that is used for releasing the second refrigerant from the at least one superconducting electrical component as a working fluid.

22. The natural gas processing facility of claim 21, wherein:

a portion of the primary refrigerant is directed to the ancillary refrigeration unit;

a primary warmed refrigerant outlet line releases warmed refrigerant from the primary refrigeration unit;

a primary warmed refrigerant outlet line releases warmed refrigerant from the ancillary refrigeration unit;

the outlet lines for the primary warmed refrigerant from the primary and ancillary refrigeration units are merged into a combined warm refrigerant outlet line;

a first compressor is provided for re-compressing the warmed refrigerant in the combined warmed refrigerant outlet line, the warmed refrigerant in the combined warmed refrigerant outlet line being partially cooled and then circulated back into the primary refrigeration unit as the first refrigerant and the ancillary refrigeration unit; and a second compressor is provided for re-compressing the second refrigerant in the outgoing refrigerant line, the second refrigerant being partially cooled and then circulated back into the primary refrigeration unit.

23. The natural gas processing facility of claim 19, wherein the facility further comprises:

a primary warmed refrigerant outlet line for releasing warmed refrigerant from the primary refrigeration unit;

a first compressor for re-compressing the warmed refrigerant in the primary warmed refrigerant outlet line, the warmed refrigerant in the primary warmed refrigerant outlet line being partially cooled and then circulated back into the primary refrigeration unit as the first refrigerant; and a second compressor for re-compressing the second refrigerant in the outgoing refrigerant line, the second refrigerant being partially cooled and then circulated back into the primary refrigeration unit.

24. The natural gas processing facility of claim 18, wherein:

the second refrigerant for maintaining the at least one superconducting electrical component below a critical temperature comprises a portion of the liquefied natural gas from the natural gas outlet line;

the portion of the liquefied natural gas is taken from the natural gas outlet line as a slip stream; and the slip stream is in fluid communication with the incoming refrigerant line for delivering the second refrigerant to the at least one superconducting electrical component.

25. The natural gas processing facility of claim 24, wherein the facility further comprises:

a primary warmed refrigerant outlet line for releasing warmed refrigerant from the primary refrigeration unit;

a first compressor for re-compressing the warmed refrigerant in the primary warmed refrigerant outlet line, the warmed refrigerant being partially cooled and then circulated back into the primary refrigeration unit as the first refrigerant; and a second compressor for re-compressing the second refrigerant in the outgoing refrigerant line, the second refrigerant being either (i) circulated back into the primary refrigeration unit for re-chilling, (ii) used as fuel gas for the facility, or (iii) both (i) and (ii).

26. The natural gas processing facility of claim 25, wherein:

the liquefied natural gas in the natural gas outlet line comprises heavier hydrocarbons;

the heavier hydrocarbons are removed from cooling lines delivering the second refrigerant to the at least one superconducting electrical component; and the removed heavier hydrocarbons are reintroduced into the natural gas inlet line.

27. The natural gas processing facility of claim 25, wherein the second refrigerant in the outgoing refrigerant line is circulated back to the primary refrigeration unit.

28. The natural gas processing facility of claim 25, wherein the facility further comprises:

an end flash system that (i) receives the liquefied natural gas from the natural gas outlet line, (ii) temporarily stores the liquefied natural gas, (iii) delivers a substantial portion of the liquefied natural gas to a trans-oceanic vessel or more permanent on-shore storage, and (iv) releases end flash gas through an end-flash line; and wherein the second refrigerant is directed to the end-flash system after cooling the at least one superconducting electrical component.

29. The natural gas processing facility of claim 28, wherein the end flash gas is circulated back into the primary refrigeration unit.

30. The natural gas processing facility of claim 28, wherein the second refrigerant in the outgoing refrigerant line is merged with the end flash gas.

31. The natural gas processing facility of claim 18, wherein:

liquefied natural gas in the natural gas outlet line is sub-cooled in the primary refrigeration unit below a critical temperature of the at least one superconducting electrical component;

at least a portion of the sub-cooled liquefied natural gas is used as the second refrigerant;

the second refrigerant in the outgoing refrigerant line is introduced into an end flash system that (i) receives the liquefied natural gas from the outgoing refrigerant line, (ii) temporarily stores the liquefied natural gas, (iii) delivers a substantial portion of the liquefied natural gas to a trans-oceanic vessel or more permanent on-shore storage, and (iv) releases end flash gas through an end-flash line.

32. The natural gas processing facility of claim 1, further comprising:

a storage device for holding a source of refrigerant;

an expansion device for cooling the source of refrigerant and releasing the source of refrigerant to the superconducting electrical components during start-up of the facility.

33. The natural gas processing facility of claim 1, further comprising:

an exit line for releasing gas from the second refrigerant in the outgoing refrigerant line and (i) delivering the gas as fuel for the facility, (ii) delivering the gas back to the primary refrigeration unit for reliquefaction, or (iii) venting the gas.

34. The natural gas processing facility of claim 25, wherein boil-off natural gas is recovered from LNG storage tanks, from loading lines, from vapors displaced during the loading of an LNG ship, or combinations thereof, and merged with the second refrigerant outlet line before feeding the second compressor.

35. The natural gas processing facility of claim 1, wherein:

the liquefied natural gas from the natural gas outlet line produces LNG end flash gas; and the second refrigerant is cooled by chilling in heat exchange with (i) LNG end-flash gas, (ii) gas produced from boiling of an LNG storage tank, (iii) gas produced from boil-off natural gas in loading lines, (iv) gas displaced during loading of an LNG ship, or (v) combinations thereof.

36. The natural gas processing facility of claim 1, wherein improving electrical efficiency of the superconducting service by at least one percent over what would be experienced through the use of conventional electrical components comprises increasing the efficiency of liquefaction of natural gas in terms of (i) LNG per unit power, (ii) LNG per unit fuel demand, or (iii) LNG per unit emissions.

* * * * *